US007926638B2

(12) United States Patent
O'Byrne

(10) Patent No.: US 7,926,638 B2
(45) Date of Patent: Apr. 19, 2011

(54) COIN MECHANISM AND VALIDATOR IMPROVEMENTS

(75) Inventor: Kenneth J. O'Byrne, Brisbane (AU)

(73) Assignee: Transtoll Pty Ltd, Eight Mile Plains (AU)

( * ) Notice: Subject to any disclaimer, the term of this patent is extended or adjusted under 35 U.S.C. 154(b) by 210 days.

(21) Appl. No.: 12/238,009

(22) Filed: Sep. 25, 2008

(65) Prior Publication Data

US 2010/0072024 A1 Mar. 25, 2010

(51) Int. Cl.
*G07D 1/00* (2006.01)

(52) U.S. Cl. ..... 194/302; 453/34; 453/57

(58) Field of Classification Search ..... 194/302; 453/18, 19, 20, 34, 35, 49
See application file for complete search history.

(56) References Cited

U.S. PATENT DOCUMENTS

| | | | | | |
|---|---|---|---|---|---|
| 915,965 | A | * | 3/1909 | Johnson | 453/13 |
| 1,902,328 | A | * | 3/1933 | Howenstine | 453/34 |
| 2,348,936 | A | * | 5/1944 | Sprenger | 453/12 |
| 3,933,162 | A | | 1/1976 | Smith | |
| 4,234,003 | A | | 11/1980 | Ristvedt et al. | |
| 4,476,884 | A | | 10/1984 | Gonzalez | |
| 4,538,719 | A | | 9/1985 | Gray et al. | |
| 4,561,457 | A | * | 12/1985 | Sasaki | 453/5 |
| 4,598,724 | A | | 7/1986 | Boland | |
| 5,240,099 | A | * | 8/1993 | Brown et al. | 194/317 |
| 5,293,979 | A | | 3/1994 | Levasseur | |
| 5,607,351 | A | | 3/1997 | Schwartz | |
| 2001/0046837 | A1 | | 11/2001 | Brown et al. | |
| 2003/0121326 | A1 | | 7/2003 | Paslay | |
| 2005/0006197 | A1 | | 1/2005 | Wendell et al. | |
| 2006/0151285 | A1 | | 7/2006 | String | |

FOREIGN PATENT DOCUMENTS

| | | | |
|---|---|---|---|
| AU | 645548 | B2 | 1/1994 |
| EP | 1594095 | A1 | 11/2005 |

* cited by examiner

*Primary Examiner* — Stefanos Karmis
*Assistant Examiner* — Mark J Beauchaine
(74) *Attorney, Agent, or Firm* — Blank Rome LLP

(57) ABSTRACT

Disclosed is a coin acceptor mechanism with a coin pick-up wheel for advancing coins in a radial path. The pick-up wheel comprises a plurality of scalloped portions disposed at a peripheral edge thereof that each includes a first rounded portion of a first radius extending into the peripheral edge of the pick-up wheel having a first radius, a second rounded portion of a second radius disposed in a trailing edge of the first rounded portion and having a second radius, a chamfered portion extending along a top edge of the first rounded portion and the second rounded portion, an internal edge extending perpendicular from a bottom surface of the pick-up wheel along a bottom edge of the first rounded portion and the second rounded portion and intersecting the chamfered portion, and a straight portion disposed between the peripheral edge of the pick-up wheel and the second rounded portion for guiding the coins into the second rounded portion, wherein the straight portion includes a beveled portion for reducing the surface area thereof and preventing excess coins from getting caught thereon as the pick-up wheel advances coins.

20 Claims, 9 Drawing Sheets

COIN MECHANISM AND VALIDATOR IMPROVEMENTS

CROSS REFERENCE TO RELATED PATENTS

This patent application is related to U.S. Pat. No. 5,240,099, issued Aug. 31, 1993, entitled "Coin Receiving and Validating Apparatus" by Brown et al., which has the same assignee as the subject patent application, the disclosure of which is incorporated herein by reference.

FIELD OF THE INVENTION

This invention relates to a coin receiving and validation apparatus. More particularly, the present invention relates to a coin receiving and validation apparatus with improved means for more effectively advancing and validating coins.

BACKGROUND OF THE INVENTION

In response to the increasing popularity of toll roads, coin receiving and validation apparatus have been provided to permit increased speed, accuracy and uniformity of operation, both in sensing defective or foreign coins and in sensing the correct value of each coin deposited into the apparatus. To permit increased speed, accuracy and uniformity of coin validation, automatic coin apparatus have been provided with rotating members for angularly advancing coins at a predetermined and uniform speed within the coin acceptor and escrow assembly, regardless of coin diameter. In addition, to further increase speed, automatic coin apparatuses have been provided with single-stage coin validation in which the same pulse set is used with a single coil assembly for both detection and classification of a coin, as compared to two-stage validation wherein a coin must first roll past a first detection coil and then, if the coin is accepted, it is allowed to roll past a second coil that activates classification pulses. An example of an automatic coin apparatus that includes such features is described in U.S. Pat. No. 5,240,099 to Brown et al., which is assigned to the assignee of the present application.

The automatic coin apparatuses presently in use, however, have a number of disadvantages. For example, when using a disc-shaped rotating member, or pick-up wheel, to angularly advance coins within the coin acceptor, more than one coin may be picked up by scalloped portions in the pick-up wheel, which can cause incorrect coil readings during coin validation. In an attempt to remedy those problems, pick-up wheels were provided with chamfered scalloped portions of different sizes to accommodate coins of different diameters and thicknesses.

As illustrated in FIG. 1, a pick-up wheel 100 known pick-up wheel is illustrated in which a plurality of round scalloped portions 102 and 104 are included for receiving coins therein. A plurality of large scalloped portions 102 are provided for receiving large and small coins, and a plurality of smaller scalloped portions 104 are provided to receive small coins. The smaller scalloped portions 104 are provided to account for inefficiencies inherent in advancing coins with smaller dimensions, such as a greater likelihood of the coin superimposing on top of another coin in a scalloped portion or becoming jammed between the pick-up wheel and a planar base of the coin acceptor. But, while the inefficiencies associated with small coins are reduced by having different sized scalloped portions 102 and 104, the inefficiencies associated with large coins are increased.

Each scalloped portion 102 and 104 includes a first chamfered portion 106 and 108 extending along a leading edge and an inside edge of the circumference of each scalloped portion 102 and 104 and a second chamfered portion 110 and 112 extending along a trailing edge of the circumference of each scalloped portion 102 and 104. The first chamfered portion 106 and 108 is adapted to allow coins to slide into the scalloped portions 102 and 104 as the pick-up wheel 100 rotates in the direction or arrow "A", and the second chamfered portion 110 and 112 is adapted to allow excess coins to slide out of the scalloped portions 102 and 104 as the pick-up wheel 100 rotates in the direction or arrow "A". Each of the chamfered portions 106, 108, 110, and 112 extends at an angle from a top surface of the pick-up wheel 100 to an internal edge 114 and 116 of each scalloped portion 102 and 104 that extends perpendicular from a bottom surface of the pick-up wheel 100. The internal edge 114 and 116 is provided to engage a coin in each scalloped portion 102 and 104 and advance the coin as the pick-up 100 wheel rotates while allowing excess coins, such as a coin superimposed on the coin in the scalloped portion 102 or 104, to slide away from the respective scalloped portion 102 or 104 as the pick-up wheel 100 rotates. The internal edge 114 and 116 of both the large scalloped portions 102 and the small scalloped portions 104, however, is between 0.8 mm and 1.0 mm in thickness, which is not sufficient to consistently engage larger coins, such as nickels (thickness=1.95 mm) and quarters (thickness=1.75 mm), with a thickness close to double that of the internal edge.

A notched portion 118 and 120 is disposed at the trailing edge of each scalloped portion 102 and 104 to stabilize a coin disposed therein and to maintain the coin in the proper position to be detected and classified. The second chamfered portion 110 and 112 of each scalloped portion 102 and 104 extends substantially around each notched portion 118 and 120. Each notched portion 118 and 120 is defined by a cutout with a radius smaller than that of its respective scalloped portion 102 and 104. The radius of the notched portion 118 and 120 of both the large scalloped portions 102 and the small scalloped portions 104, however, is 10.0 mm, which is not sufficient to stabilize smaller coins, such as pennies (diameter=19.05 mm) and dimes (diameter=17.91 mm), with radii nearly 1.0 mm smaller than that of the notched portions 118 and 120.

A non-chamfered portion 122 and 124 is disposed between the notched portion 118 and 120 and the peripheral edge of the of the pick-up wheel 100 in each scalloped portion to assist in capturing and guiding each coin into each scalloped portion's 102 and 104 respective notched portion 118 or 120 where each coin can be detected and classified. The non-chamfered portion 124 of the small scalloped portion 104 is larger than the non-chamfered portion 122 of the large scalloped portion 102 in order to maintain coins captured in the small scallops 104 at substantially the same distance from the center of the pick-up wheel 100 as coins captured in the large scallops 102, i.e., to guide coins captured in the small scallops 104 along substantially the same radial path as coins captured in the large scallops 102 as the pick-up wheel 100 rotates in the direction or arrow "A". This configuration ensures that coins in the small scallops 104 as well as in the large scallops 102 are positioned at the proper location for detection and identification as each one passes over the coin validation area (not shown). The configuration also positions the smaller coins further away from the outer perimeter of the pick-up wheel, which is where such smaller coins are most likely to become jammed between the pick-up wheel 100 and the planar base of the coin acceptor.

Coins are more likely to become jammed between the pick-up wheel 100 and the planar base of the coin acceptor at the outer perimeter of the pick-up wheel 100 because there is a larger amount of deflection of the pick-up wheel 100 at points further from the center thereof. Deflection of the pick-up wheel 100 causes variation in the height of the internal edge 114 and 116 of the scallops 102 and 104 at the notched portions 118 and 120, which causes unwanted excess coins to be dragged through the validation area and results in valid coin rejects and coin jams. Moreover, the thickness of the pick-up wheel is only 2.2 mm, which is not enough to sufficiently reduce deflection at the outer perimeter of the pick-up wheel 100 and therefore may allow smaller, thinner coins to become jammed between the pick-up wheel 100 and the planar base of the coin acceptor at the outer perimeter of the pick-up wheel 100. And, when operating the pick-up wheel 100 in wet conditions, greater clearance must be provided between the pick-up wheel 100 and the planar base of the coin acceptor, which further contributes to the likelihood that coins will become jammed therebetween.

In addition, the non-chamfered portion 124 of the small scalloped portion 104, however, is 7.0 mm long, which creates a surface area large enough to catch coins in and around the scalloped portions 102 and 104 thereon and to drag those coins around the perimeter of the pick-up wheel 100 so as to cause reject errors when the extra coins move through the validation area. Accordingly, there is a need for a coin receiving and validation apparatus with improved efficiency.

SUMMARY OF THE INVENTION

To solve at least the above problems and/or disadvantages and to provide at least the advantages described below, a non-limiting object of the present invention is to provide a coin acceptor mechanism with a coin pick-up wheel for advancing coins in a radial path, the pick-up wheel comprising a plurality of scalloped portions disposed at a peripheral edge thereof that each includes a first rounded portion of a first radius extending into the peripheral edge of the pick-up wheel having a first radius, a second rounded portion of a second radius disposed in a trailing edge of the first rounded portion and having a second radius, a chamfered portion extending along a top edge of the first rounded portion and the second rounded portion, an internal edge extending perpendicular from a bottom surface of the pick-up wheel along a bottom edge of the first rounded portion and the second rounded portion and intersecting the chamfered portion, and a straight portion disposed between the peripheral edge of the pick-up wheel and the second rounded portion for guiding the coins into the second rounded portion, wherein the straight portion includes a beveled portion for reducing the surface area thereof and preventing coins from getting caught thereon as the coin wheel advances coins.

Another non-limiting object of the present invention is to provide a coin acceptor mechanism that further includes a circular base with a top surface, an annular wall disposed around the pick-up wheel at a peripheral edge of the circular base, a deflection spring disposed on the annular wall and configured to deflect at least one second coin away from the annular wall when the at least one second coin becomes at least one of superimposed on the first coin or partially disposed in a scalloped portion, at least one first brush disposed on the annular wall and configured to complete removal of the at least one second coin from the scalloped portion prior to the scalloped portion moving past a coin validation area as the pick-up wheel rotates, at least one second brush disposed on the annular wall and configured to accomplish at least one of seating flush and stabilizing the first coin in the scalloped portion as the scalloped portion moves past the coin validation area, a pressure plate disposed on a top surface of the pick-up wheel and configured to maintain the pick-up wheel a desired distance from the top surface of the circular base without covering up the plurality of scalloped portions, and a retaining knob disposed through an aperture in the pressure plate that is configured to attach to a rotating shaft and retain the pick-up wheel at the desired distance from the top surface of the circular base with pressure from the pressure plate, wherein the desired distance is a distance that prevents a coin in a scalloped portion from becoming jammed between the pick-up wheel and the top surface of the circular base.

It is yet another non-limiting object of the present invention to provide a coin escrow assembly that includes a cylindrical housing comprising a peripheral wall extending from a bottom surface of the cylindrical housing, a coin outlet aperture extending through the bottom surface, a latching mechanism disposed on an outer surface of the peripheral wall, and a plurality of cams disposed on the outer surface of the peripheral wall, wherein the latch mechanism and the plurality of cams are disposed a substantially equal distance apart near a top edge of the peripheral wall; an escrow cover disposed on a top edge of the peripheral wall so as to substantially enclose the escrow assembly, the escrow cover comprising a latch catch configured to engage with the latching mechanism with minimal clamping force when the latch catch is in alignment with the latching mechanism, and a plurality of cam catches with openings therein each configured to receive one of the plurality of cams as the latch catch is aligned with the latching mechanism, wherein the latch catch is aligned with the latching mechanism by placing the escrow cover on the top edge of the peripheral wall and rotating the escrow cover until the latch catch is positioned directly above the latching mechanism and the cam catches receive the cams; an escrow paddle rotatably disposed in the cylindrical housing and having at least two arms extending radially from a central portion thereof, the at least two radially extending arms comprising a ramped portion configured to cause at least one coin to slide down onto the bottom surface of the cylindrical housing as the escrow paddle rotates, and an abutment surface configured to move at least one coin in a path along the bottom surface of the cylindrical housing as the escrow paddle rotates until the coin is deposited through the coin outlet aperture; a paddle insert configured to prevent the at least one coin from becoming jammed between the escrow cover and the escrow paddle, the paddle insert comprising a semi-circular portion configured to mount flush with the peripheral wall, and an extended curved portion extending radially from an end of the semi-circular portion and configured to further prevent the at least one coin from becoming jammed between the escrow cover and the escrow paddle by providing additional material where the at least one coin is most likely to become jammed.

The coin acceptor mechanism may utilize a coin identification and validation process that includes the steps of applying a first pulse set to determine when a coin enters a coin validation area, applying a second pulse set to determine the classification of the coin in the coin validation area, and applying the first pulse set to determine when the coin leaves the coin validation area, wherein applying the first pulse set and applying the second pulse set do not occur concurrently.

These and other objects of the invention, as well as many of the intended advantages thereof, will become more readily apparent when reference is made to the following description, taken in conjunction with the accompanying drawings.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE INVENTION

Figure 1:
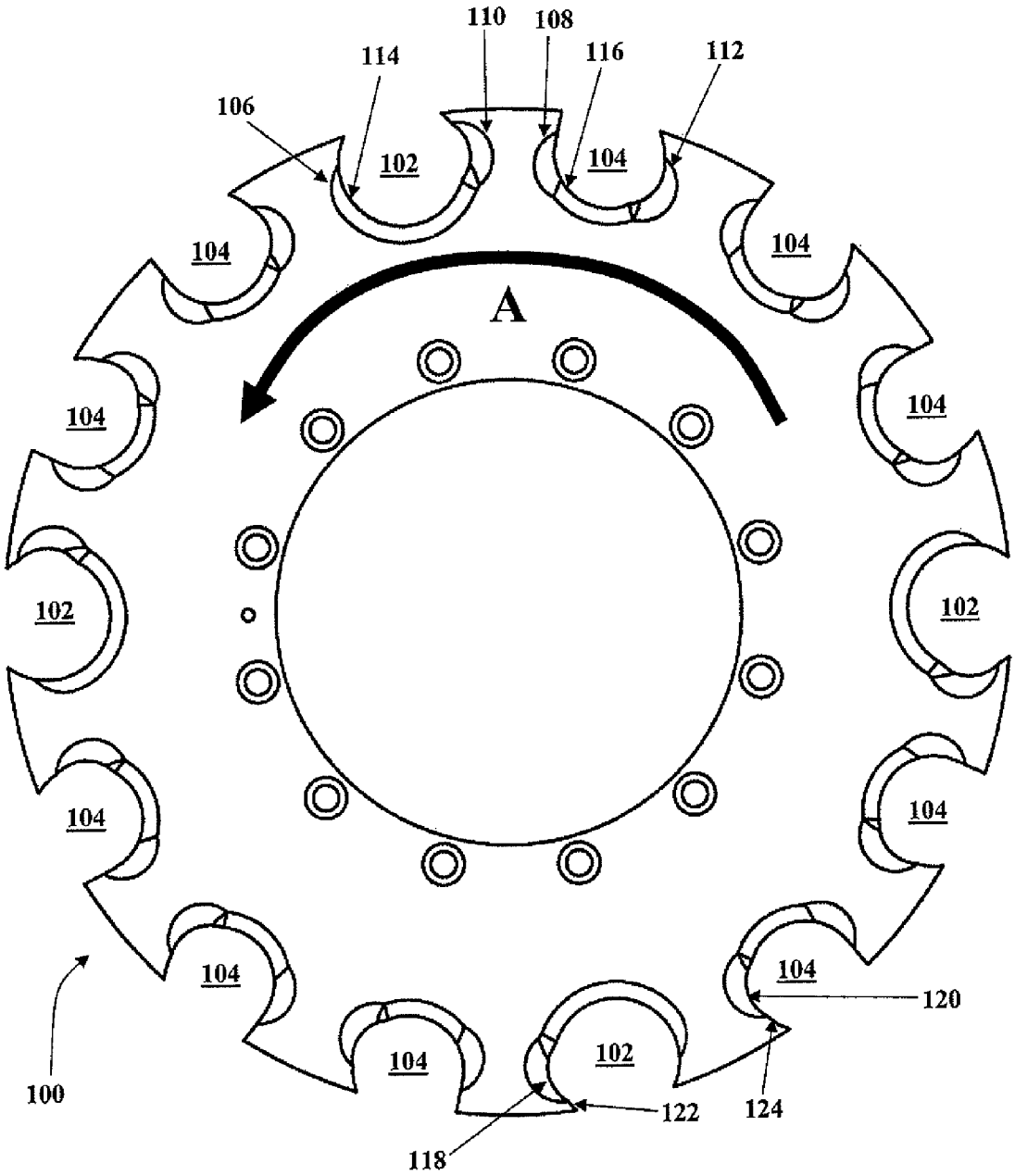
FIGURE 1 (PRIOR ART)
FIG. 1 illustrates a plan view of a prior art coin pick-up wheel.

Reference will now be made in detail to non-limiting embodiments of the present invention by way of reference to the accompanying drawings, wherein like reference numerals refer to like parts, components and structures.

Figure 2:
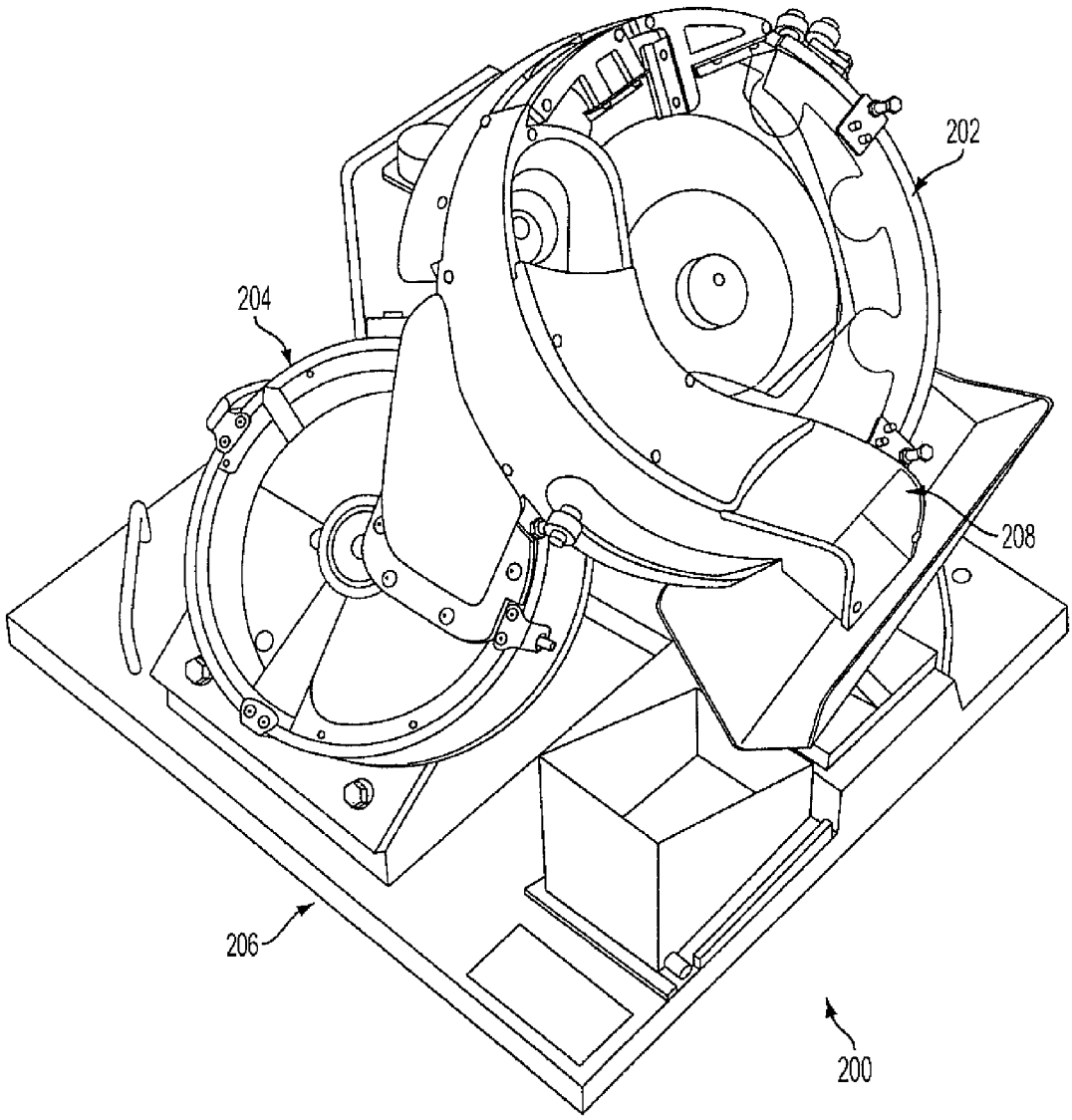
FIG. 2 illustrates an orthogonal view of a coin validation apparatus according to a non-limiting embodiment of the present invention.

Turning to the figures, FIG. 2 shows an orthogonal view illustrating a non-limiting embodiment of the automatic coin validation apparatus 200 according to the present invention. The automatic coin apparatus includes a coin acceptor mechanism 202 and an escrow assembly 204 mounted on a planar base 206. The coin acceptor mechanism 202 is adapted to receive coins and either deposit accepted coins into the escrow assembly 204 or eject rejected coins back to a customer via a coin return chute 208. The escrow assembly 204 is adapted to hold accepted coins until the correct number and classification of coins is deposited therein by the coin acceptor mechanism 202, at which point the coins are deposited in a vault chamber (not shown) disposed below the planar base 206 of the automatic coin validation apparatus 200.

Coin Acceptor Mechanism

Figure 3:
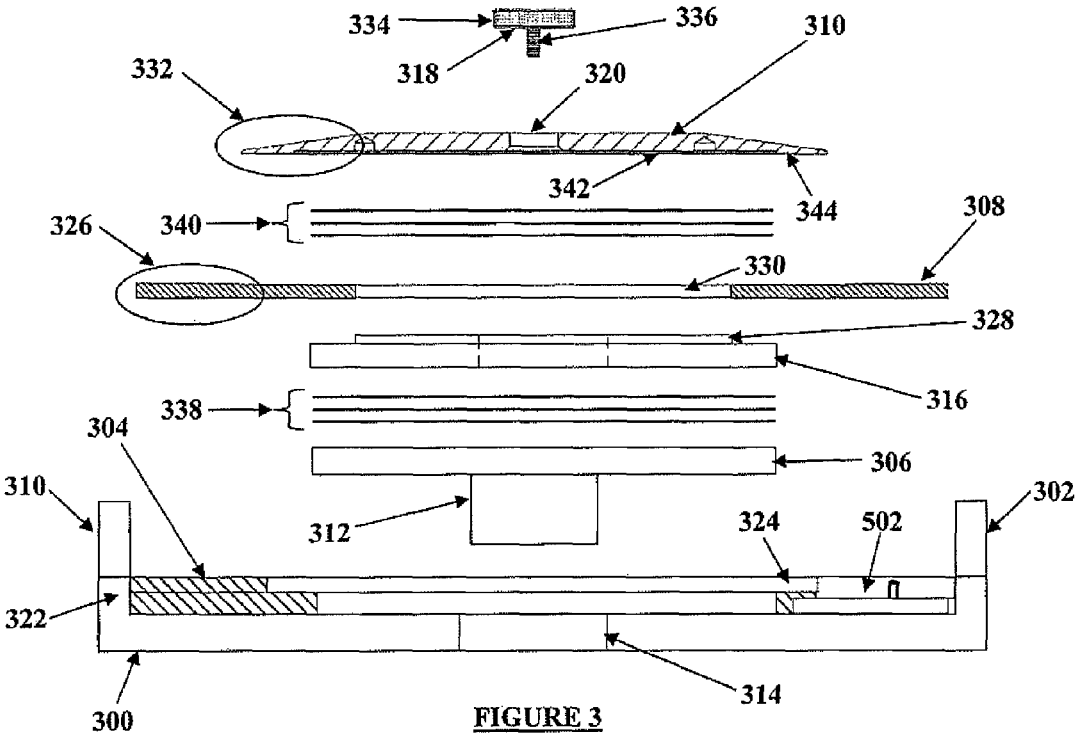
FIG. 3 illustrated an exploded sectional view of a non-limiting embodiment of the coin acceptor mechanism of the present invention.
Figure 4:
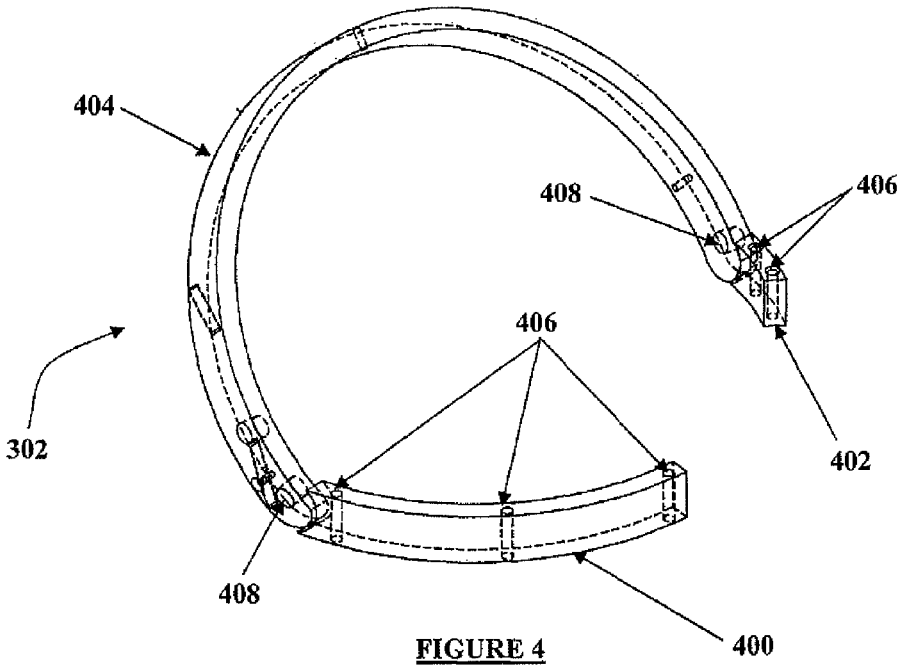
FIG. 4 illustrates an orthogonal view of a non-limiting embodiment of the annular wall of the coin acceptor mechanism illustrated in FIG. 3.
Figure 5:
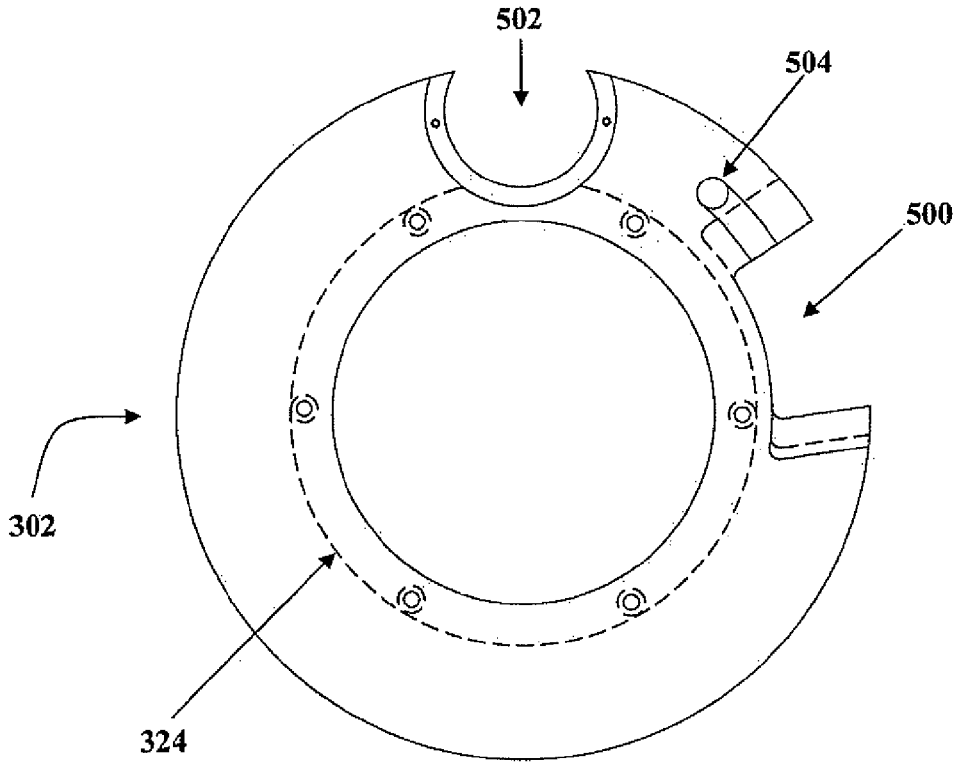
FIG. 5 illustrates a plan view of a non-limiting embodiment of the circular base and backing plate of the coin acceptor mechanism illustrated in FIG. 3.

As illustrated in FIG. 3, the coin acceptor mechanism 202 includes a circular base 300 upon which is disposed an annular wall 302 (shown in more detail in FIG. 4) and a backing plate 304 (shown in more detail in FIG. 5). The coin acceptor mechanism 202 also includes a boss plate 306, a coin pick-up wheel 308 (shown in more detail in FIGS. 6 and 7), and a pressure plate 310 connected to a pick-up wheel shaft 312. Each of the backing plate 304, boss plate 306, coin pick-up wheel 308, and pressure plate 310 is substantially disc/circular shaped, and the annular wall 300 is substantially ring shaped. The backing plate 304 and annular wall 302 are installed on the circular base 300 using known fastening mechanisms (not shown). The boss plate 306 is connected directly to the pick-up wheel shaft 312, which is adapted to extend through an aperture 314 disposed substantially in the center of the circular base 300 and extending therethrough. The pick-up wheel 308 is installed on the boss plate 306 using a hub portion 316 adapted to mate a bottom surface of the pick-up wheel 308 to a top surface of the boss plate 306 using known fastening mechanisms (not shown). The pressure plate 310 is installed on a top surface of the pick-up wheel 308 using an retaining knob 318 installed trough an orifice 320 extending through the pressure plate 310 substantially at the center thereof.

The circular base 300 includes a raised portion 322 around its circumference extending substantially perpendicular to a top surface of the circular base 300 so as to define a central portion therebetween in which the backing plate 304 is installed. The annular wall 302 is installed on the circular base 300 at the raised portion 322. The coin pick-up wheel 308 has a diameter that is smaller than the inner diameter of the annular wall 302, but the two are close enough in diameter that the clearance therebetween is not large enough for a coin to be disposed therein.

The backing plate 304 also includes a circular recessed portion 324 disposed substantially in the middle thereof. The circular recessed portion 324 is adapted to receive the boss plate 306 rotatably disposed therein. The boss plate 306 has a smaller diameter than the pick-up wheel 308 so that an outer periphery portion 326 of the pick-up wheel 308 extends over the backing plate 304 when the pick-up wheel 308 is mounted on the boss plate 306. The hub portion 316 is of substantially the same diameter as the boss plate 306 for mounting thereto and includes a raised portion 328 of substantially the same diameter as a central aperture 330 in the pick-up wheel 308. The raised portion 328 is adapted to slidably engage the central aperture 330 to center the pick-up wheel 308 on the hub portion 316 when the pick-up wheel 308 is installed thereon. The pressure plate 310 has a smaller diameter than the pick-up wheel 308 and a larger diameter than the boss plate 306 and fits within a recess 600 (shown in more detail in FIG. 6) in the top of the pick-up wheel 308 so that an outer periphery portion 332 of the pressure plate 310 extends over the outer periphery portion 326 of the pick-up wheel 308 without covering up a plurality of scalloped portions 602 (shown in more detail in FIGS. 6 and 7) disposed in the outer periphery portion 326 of the pick-up wheel 308.

In this configuration, the pressure plate 310 is used to place pressure on the outer periphery portion 326 of the pick-up wheel 308 by placing the retaining knob 318 through the orifice 320 in the pressure plate 310 and tightening it. The amount of pressure can be adjusted by tightening or loosening the adjustment knob 318. The retaining knob 318 may include a knurled section 334 for manually rotating the retaining knob 318 and a threaded portion 336 for engaging a corresponding threaded portion on the pick-up wheel shaft 312. Upward and downward motion of the adjustment knob 318 corresponds directly to the amount the adjustment knob 318 is rotated. Accordingly, downward motion of the adjustment knob 318 correlates to "tightening" and upward motion of the adjustment knob 318 correlates to "loosening" as used herein. In addition, downward motion corresponds to motion toward the boss plate 306 and the pick-up wheel 308.

Pick-up wheel adjusting shims 338 are placed between the boss plate 306 and the assembled pick-up wheel 308 and hub 316 to establish the required clearance between the backing plate 304 and the outer periphery portion 326 of the pick-up wheel 308. Pressure plate adjusting shims 340 are placed between the top surface of the pick-up wheel 308 and a bottom surface of the pressure plate 310 in a sufficient quantity to maintain the previously adjusted clearance between the backing plate 304 and the outer periphery portion 326 of the pick-up wheel 308 when the retaining knob 318 is installed and clamps the assembled pick-up wheel 308 and hub 316 in position on the pick-up wheel shaft 312. The desired clearance between the backing plate 304 and the outer periphery portion 326 of the pick-up wheel 308 is one that prevents smaller, thin coins, such as dimes (10¢), from jamming between the backing plate 304 and the pick-up wheel 308 and may include placing the outer periphery portion 326 of the pick-up wheel 308 in close relation to the backing plate 304 as the pick-up wheel 308 rotates with the boss plate 306. Accordingly, the outer periphery portion 326 of the pick-up wheel 308 and the backing plate 304 may be formed of materials that reduce the amount of moving friction therebetween. By allowing the clearance between the outer periphery portion 326 of the pick-up wheel 308 and the backing plate 304 to be adjusted with the adjustment knob 318 by adding and removing shims 338 and 340, greater rotational speeds can be achieved for the pick-up wheel 308 while preventing coins from jamming between the pick-up wheel 308 and the backing plate 304.

As also illustrated in FIG. 3, the pressure plate 310 includes a chamfered portion at its outer periphery portion 328 that fits into the recess 600 in the pick-up wheel 308 so that coins will slide across the pressure plate 310 when moving from a top portion of the coin acceptor mechanism 202 to a bottom portion of the coin acceptor mechanism 202 without getting hung up on the pressure plate's 310 peripheral edge. The pressure plate 310 also includes a recessed portion 342 in a bottom surface thereof that is adapted to provide improved adjustment and control of the outer periphery portion 326 of the pick-up wheel 308. The recessed portion 342 extends from the central portion of the pressure plate 310 towards a peripheral edge thereof. By providing a recessed portion 342 extending towards the peripheral edge of the pressure plate 310, pressure is concentrated nearer to the peripheral edge of the pressure plate 310, which applies pressure nearer to the peripheral portion 326 of the pick-up wheel 308. In addition, if tightening the adjustment knob 318 causes the pressure plate 310 to deflect upwards at its peripheral edge, pressure will remain concentrated at the peripheral edge of the pressure plate 310, particularly at an inside edge 344 formed by the intersection of the recessed portion 342 and the peripheral edge of the pressure plate 310.

As illustrated in FIG. 4, the annular wall 302 comprises two fixed wall members 400 and 402 and a movable annular wall member, or dumping ring, 404. The fixed wall members 400 and 402 include a larger fixed wall member 400 and a smaller fixed wall member 402 that are installed on the raised portion 322 of the circular base 300 at opposite ends of the dumping ring 404. The fixed wall members 400 and 402 are stationary mounted to the circular base 300 at the raised portion 322 using known fastening mechanisms (not shown) installed through a plurality of mounting holes 406 disposed in each of the fixed wall members 400 and 402 and received in corresponding mounting holes (not shown) in the top surface of the raised portion 322 of the circular base 300. The dumping ring 404 is pivotally mounted at the outer perimeter of the circular base 300 at opposing sides via rotatable links 900 (shown in more detail in FIG. 9) that are received in mounting holes 408 disposed at opposing ends of the dumping ring 404. Together with an inner wall of the coin return chute 208, the fixed wall members 400 and 402 and the dumping ring 404 form an enclosed peripheral wall around the outer perimeter of the circular base 300.

As illustrated in FIG. 5, the backing plate 304 includes a coin discharge slot 500, a coin validation region 502, and a coin rejecter aperture 504 disposed at the periphery thereof. The circular base 300 includes openings disposed in the periphery thereof that are adapted to align with the coin discharge slot 500 and the coin rejecter aperture 504 in the backing plate 304. The coin discharge slot 500 comprises a substantially rectangular cutout along the periphery of the backing plate 304 through which accepted coins may be deposited into the escrow assembly 204. The coin validation region 502 is formed by an area along the periphery of the backing plate 304 that is adapted to receive a coin validation device (not shown), such as a coil assembly, mounted therein. The coin validation region 502 may comprise a recessed portion disposed in, or an orifice extending through, either or both of the circular base 300 and the backing plate 304. The coin rejecter aperture 504 is disposed between the coin discharge slot 500 and the coin validation region 502 and comprises a hole extending through the circular base 300 and the backing plate 304. The coin rejecter aperture 504 is configured to receive a plunger portion 1002 of a coin rejection mechanism 1000 extending therethrough (shown in more detail in FIGS. 10A and 10B).

Figure 6:
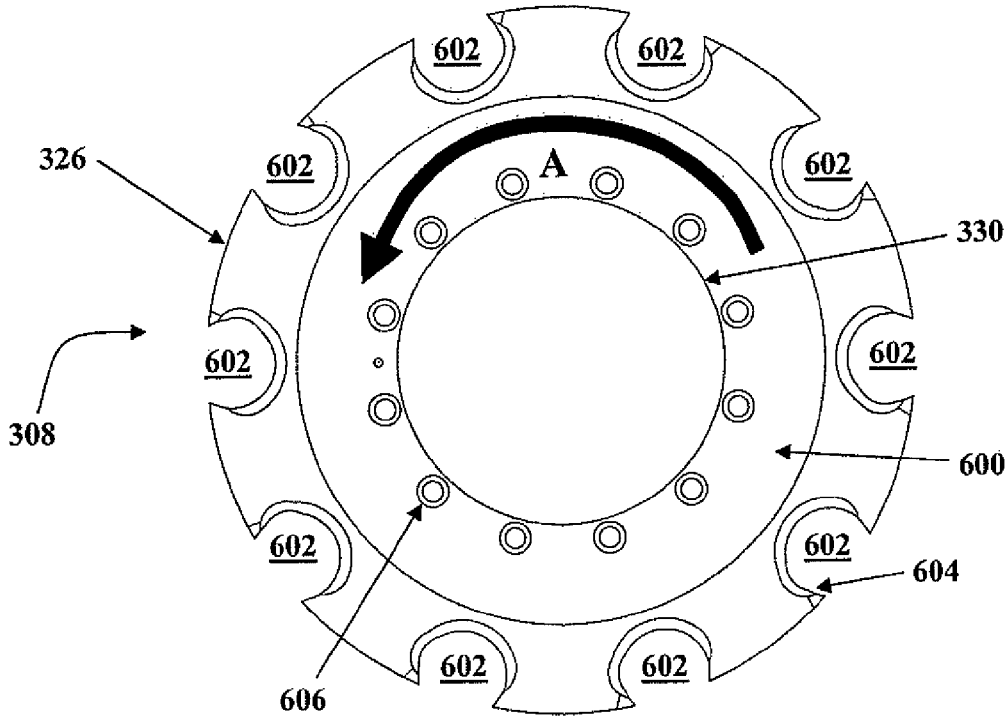
FIG. 6 illustrates a plan view of a non-limiting embodiment of the coin pick-up wheel of the coin acceptor mechanism illustrated in FIG. 3.

As illustrated in FIG. 6, the coin pick-up wheel 308 comprises central aperture 330, a recessed portion 600, and an outer periphery potion 326. The central aperture 330 extends through pick-up wheel 308 at a location substantially in the center thereof. The outer periphery portion 326 of the pick-up wheel 308 includes a plurality of substantially identical scalloped portions 602 that are adapted to receive a single coin lying flat therein, i.e., lying flush with the backing plate 304 in the same plane as the outer periphery portion 326. A trailing edge 604 of each scalloped portion 602 is adapted capture and to push a single coin in a circular pattern around the backing plate 304 as the pick-up wheel rotates in the direction of arrow "A". The recessed portion 600 includes a plurality of fastening holes 606 through which fastening mechanisms (not shown) can be installed to attach the pick-up wheel to the hub portion 316.

The recessed portion 600 is disposed in a top surface of the pick-up wheel and is of substantially the same diameter as the pressure plate 310 so that the pressure plate 310 may be received therein when installed on top of the pick-up wheel 308. By providing a recessed portion 600 for receiving the pressure plate 310, a smooth transition is provided between the pick-up wheel 308 and the pressure plate 310 such that coins are further prevented from getting hung up on the pressure plate 310 when moving from a top portion of the coin acceptor mechanism 202 to a bottom portion of the coin acceptor mechanism 202. Moreover, the pressure plate 310 can have a larger thickness at its peripheral portion 332 because the recessed portion 600 provides a smooth transition with that portion 332. A larger thickness at its peripheral portion 332 allows the pressure plate 310 to apply greater clearance controlling forces towards the peripheral portion 326 of the pick-up wheel 308, which is where it is most needed to maintain the pick-up wheel 308 within the clearance set with the backing plate 304 using the adjusting shims 338 and 340 so that smaller, thin coins do not become jammed between the pick-up wheel 308 and the backing plate 304. A larger thickness also provides for more stable vertical alignment of the notched portions 704 (shown in more detail in FIGS. 6 and 7) of the pick-up wheel 308 to prevent the dragging of unwanted excess coins through the coin validation area 502.

In addition, the peripheral portion 326 of the pick-up wheel is provided with a thickness T1 (see FIG. 7) larger than 2.2 mm to further prevent deflection at the outer perimeter of the pick-up wheel 100. The recessed portion 600 is formed with respect to the thicker peripheral portion 326 of the pick-up wheel 308. Accordingly, the larger thickness T1 of the peripheral portion 326 allows the recessed portion 600 to be formed without reducing the thickness of the pick-up wheel 308 at any location. The preferred thickness T1 of the peripheral portion 326 is 3.0 mm.

Figure 7:
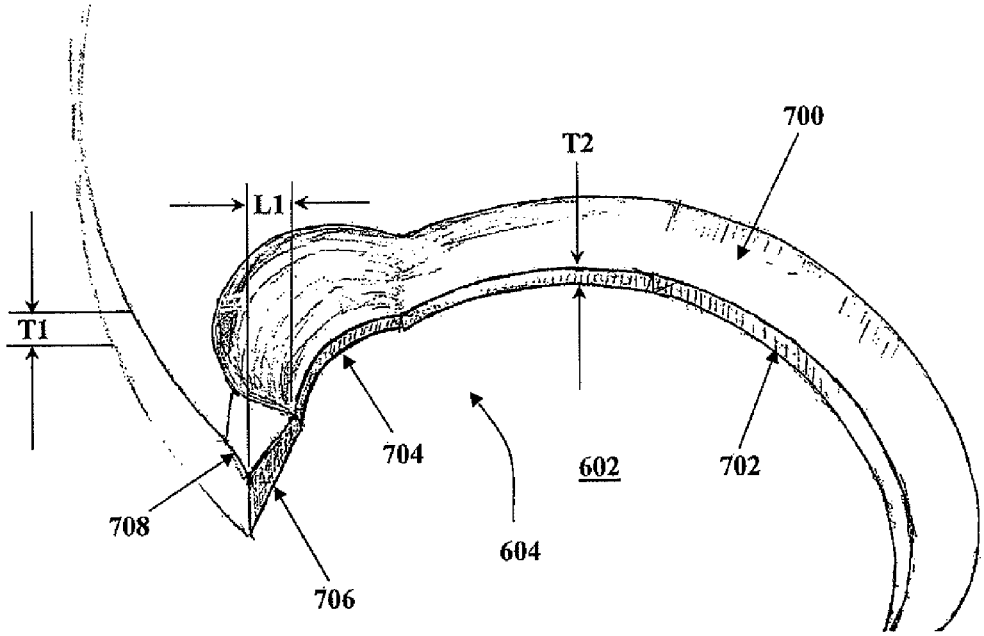
FIG. 7 illustrates an orthogonal view of the scalloped portion illustrated in FIG. 6.

As illustrated in FIG. 7, a chamfered portion 700 is provided around the circumference of each scalloped portion 602 so coins can slide into the scalloped portions 602 as the pick-up wheel 308 rotates. The scalloped portions 700 extend from the top surface of the pick-up wheel 308 to an internal edge 702 of each scalloped portion 700 that extends perpendicular to the top surface of the pick-up wheel 308. The internal edge 702 is provided to engage a coin in each scalloped portion 602 and advance the coin as the pick-up 308 wheel rotates while allowing extra coins, such as a coin superimposed on the coin in the scalloped portion 700, to slide away from the respective scalloped portion 700 as the pick-up wheel 308 rotates. Due to the increased thickness T1 of the peripheral portion 326 of the pick-up wheel 308, the thickness T2 of the internal edge 702 of the scalloped portion 602 can be increased to larger than 1.0 mm without significantly altering the chamfered portion 700. By providing an internal edge 702 with a thickness T2 greater than half the thickness of larger coins, such as nickels (thickness=1.95 mm) and quarters (thickness=1.75 mm), and less than the thickness of smaller coins, such as dimes (thickness=1.35 mm), allows the trailing edge 604 of the scalloped portion 602 to more consistently engage those coins without allowing a coin to become superimposed thereon in the scalloped portion 602. Accordingly, the thickness T2 of the internal edge 702 is preferably 1.2 mm.

A notched portion 704 is proved at a trailing edge of each scalloped portion 602 to stabilize a coin disposed therein and to maintain the coin in the proper position to be detected and classified as the pick-up wheel 308 rotates. The notched portion 704 is defined by a cutout with a radius smaller than that of the scalloped portion 602. The chamfered portion 700 follows the radius of the notched portion 704 so as to maintain a uniform chamfer angle around the scalloped portion 602. The radius of the notched portion 704 is less than 10.0 mm so that it may better stabilize smaller coins, such as pennies (diameter=19.05 mm) and dimes (diameter=17.91 mm), with radii smaller than 10.0 mm. Although the radius is reduced to accommodate smaller coins, the notched portion 704 forms a lesser arc than a half circle so that at least a portion of larger coins, such as half dollars (diameter=30.61 mm), can still be received and stabilized therein. The angle of the chamfered portion 700 is preferably 14° and the radius of the notched portion 704 is preferably 9.0 mm.

A substantially straight, non-chamfered portion 706 is disposed between the notched portion 704 and the peripheral edge of the of the pick-up wheel 602 to assist in guiding a coin into the scalloped portion's 602 notched portion 704 where the coin can be detected and classified as the pick-up wheel 308 rotates. Due to the increased thickness T1 of the peripheral portion 326 of the pick-up wheel 308, there is less deflection of the pick-up wheel 308 at its peripheral edge and the notched portion 704 can be disposed closer to the peripheral edge of the pick-up wheel 308. Accordingly, the length L1 of the non-chamfered portion 706 can be reduced to less than 7.0 mm without increasing the likelihood that smaller, thinner coins will become jammed between the pick-up wheel 308 and the backing plate 304 of the coin acceptor mechanism 202. Moreover, this removes the need to provide scalloped portions 602 of different sizes to accommodate coins of different sizes and a scalloped portion 602 of uniform dimensions can be provided for all coin sizes. The non-chamfered portion 706 preferably has a length L1 of 2.2 mm.

Although the non-chamfered portion 706 of the scalloped portion 602 is significantly smaller in length L1 than those of the prior art because a larger non-chamfered portion is no longer required to guide coins captured in the small scallops along substantially the same radial path as coins captured in the large scallops as the pick-up wheel 308 rotates in the direction or arrow "A". The increased thickness T1 of the pick-up wheel 308, however, creates a taller vertical surface along the length L1 of the non-chamfered portion 706. That increased surface area would be large enough to catch coins in and around the scalloped portions 602 and 104 thereon and to drag those coins around the perimeter of the pick-up wheel 308 so as to cause reject errors when the extra coins move through the validation area. Accordingly, the non-chamfered portion 706 also includes a beveled portion 708 to reduce the surface area thereof, which thereby reduces the drag characteristics of the non-chamfered portion 706. The beveled portion 708 extends at an angle down from the top surface of the pick-up wheel 308 to the un-chamfered portion 706 of the scalloped portion 602. The beveled portion 708 may be at a different angle than the chamfered portion 700 and differs from the chamfered portion primarily in that it is not curved around the diameter of the scalloped portion 602 but rather is straight along the non-chamfered portion 706.

The unique configuration of the pick-up wheel 308 described above provides for more efficiency in the coin acceptor mechanism. Moreover, the unique configuration allows the use of only a single, uniformly sized scalloped portion 602 for all coin sizes without compromising the efficiency of the scalloped portion 602 for either smaller or larger coins. The pick-up wheel 308 preferably includes between ten and fourteen of these uniquely shaped scalloped portions 602. The pick-up wheel 308 may also be formed from a material with low moisture absorption rates, such as a Polyacetal Copolymer, to prevent the pick-up wheel from warping under high moisture conditions.

Figure 8A:
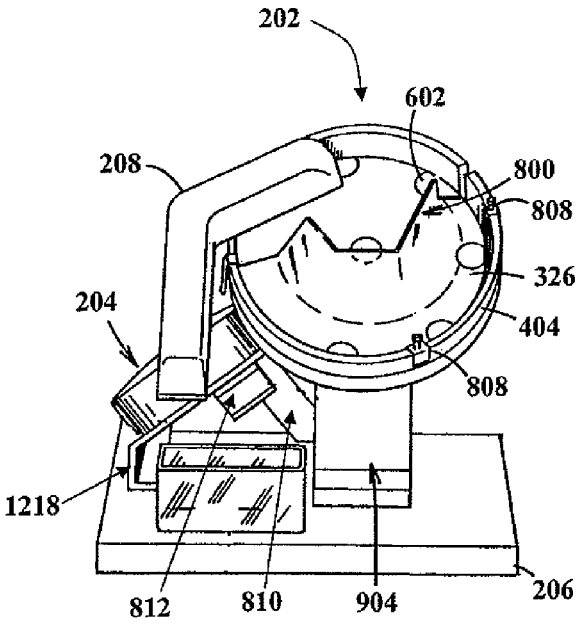
FIG. 8A illustrates a front elevation of the coin validation apparatus illustrated in FIG. 2.
Figure 8B:
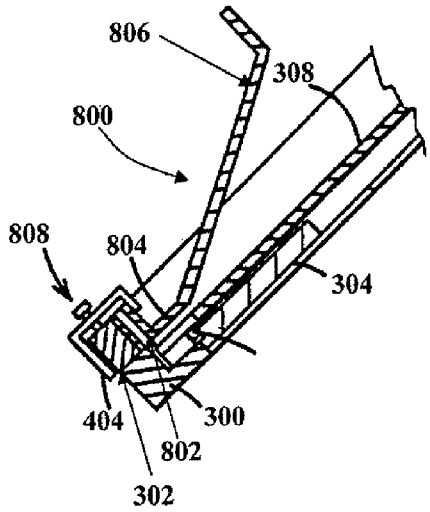
FIG. 8B illustrates a side elevation view in partial section of the coin acceptor mechanism illustrated in FIG. 8A.

As illustrated in FIGS. 8A and 8B, the coin acceptor mechanism 202 also includes a hopper 800 that is adapted to receive coins and guide them downwardly to the lower portion of the coin acceptor mechanism 202. The hopper 800 is supported by the dumping ring 404 and, therefore, will pivot with the dumping ring 404 about rotatable links 900 (shown in more detail in FIG. 9). The hopper 800 includes an annular flange portion 802 and a base wall portion 804. The annular flange portion 802 is adapted to seat with an inner wall of dumping ring 404 with epoxy resin disposed therebetween. The base wall portion 804 extends substantially perpendicular to the annular flange portion 802 so as to lie in a plane substantially parallel to the backing plate 304 and the pick-up wheel 308. An upper portion of the hopper 800 extends outwardly from the base wall portion 802 and towards the center of coin acceptor mechanism 202 to define a coin guiding portion 806.

The hopper 800 is attached to a lower portion of the dumping ring 404 by means of a plurality of adjustment screws 808. The adjustment screws 808 are disposed on the hopper 800 at locations for engaging the dumping ring 404 at different periphery positions along the dumping ring 404. The adjustment screws 808 permit the hopper 800 to be positioned at different locations that are a desired distance from the pick-up wheel 308, wherein the desired distance may correspond to the largest thickness of a coin of a specific denomination and currency. By manipulating the adjustment screws 808, the hopper 800 is easily repositioned in planes that are parallel to the pick-up wheel 308 to cause a coin to seat in a scalloped portion 602 flush with the backing plate 304 when the coin passes between the pick-up wheel 308 and the base wall portion 804 of the hopper 800.

Figure 9:
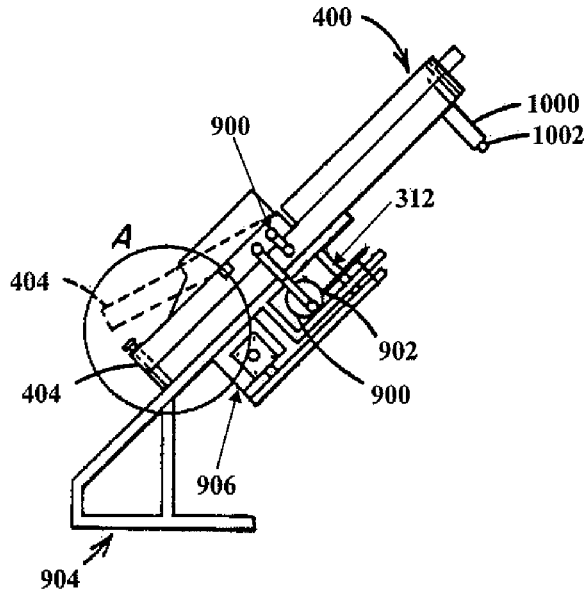
FIG. 9 illustrates a side elevation view of the coin acceptor mechanism illustrated in FIG. 8A.

As illustrated in FIG. 9, the dumping ring 404 can pivot away from the circular base 300 about rotatable links 900 under the control of a motor driven crank 902 which is connected to the dumping ring 404 via a link 904. In the normal position of the dumping ring 404, the crank 902 biases the dumping ring 404 to engage a dumping ring lock pin (not shown) so that the dumping ring 404 is substantially flush with the raised portion 322 of the circular base 300. Rotation of the crank 902 from the normal position moves the link 904 that causes the dumping ring 404 to pivot away from the circular base 300 about the rotatable links 900 and move to the position shown in a dotted outline in FIG. 9. The crank 902 is connected to any suitable driving source, such as an electric motor, that can be actuated manually or automatically.

As also illustrated in FIG. 9, the coin acceptor mechanism 202 is supported at an incline by a support member 906 so that coins deposited into the hopper 800 fall under the influence of gravity to the lower portion of the coin acceptor mechanism 202 where they remain until picked up and advanced by the pick-up wheel 308. The pick-up wheel 308 is driven by a drive motor 908 that is mounted on a back surface of the support member 906 and is connected to the pick-up wheel 308 via the shaft 312 in a manner that allows the drive motor 908 to induce rotational movement of the pick-up wheel 308. The manner in which the drive motor 908 is connected to the pick-up wheel 308 may include a clutch for engaging and disengaging with the pick-up wheel 308 as required to prevent damage in the event of jamming. Further control of the coin acceptor mechanism 202 may be achieved by means of a timing wheel (not shown) and an optoelectric sensor (not shown) associated with a microprocessor. The functionality of these elements is described in more detail in U.S. Pat. No. 5,240,099 to Brown et al., the disclosure of which is incorporated herein by reference.

Figure 10A:
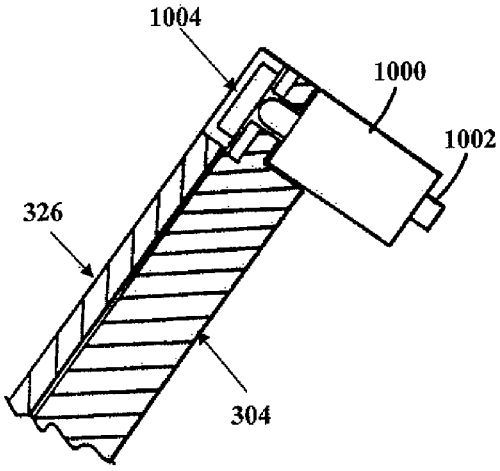
FIGS. 10A and 10B illustrate partial side elevation views of the operation of a non-limiting embodiment of the coin ejector mechanism of the present invention.
Figure 10B:
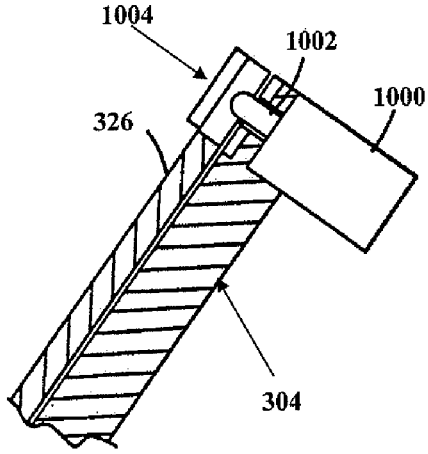

As illustrated in FIGS. 10A and 10B, the coin acceptor mechanism 202 also includes a coin rejection mechanism 1000 mounted on the back surface of the backing plate 304. The coin rejection mechanism 1000 includes a plunger portion 1002 that extends into the coin rejecter aperture 504. In the normal position, the plunger portion 1002 does not protrude from the front surface of the backing plate 304, but rather remains at least partially recessed in the coin rejecter aperture 504 so as not to interfere with the rotation of the pick-up wheel 308 or any coin 1004 in the scalloped portions 602 thereof. In use, the plunger portion 1002 may be extended through the coin rejecter aperture 504 so as to protrude from the front surface of the backing plate 304 and thereby remove a rejected coin 1004 from its corresponding scalloped portion 602 in the pick-up wheel 308. The coin 1004 may be removed from the scalloped portion 602 with sufficient velocity to direct it into the coin return chute 208. The rejection mechanism may include an electric solenoid that can be actuated manually or automatically and that is capable of rapidly advancing the plunger portion 1002 through the coin rejecter aperture 504.

Figure 11:
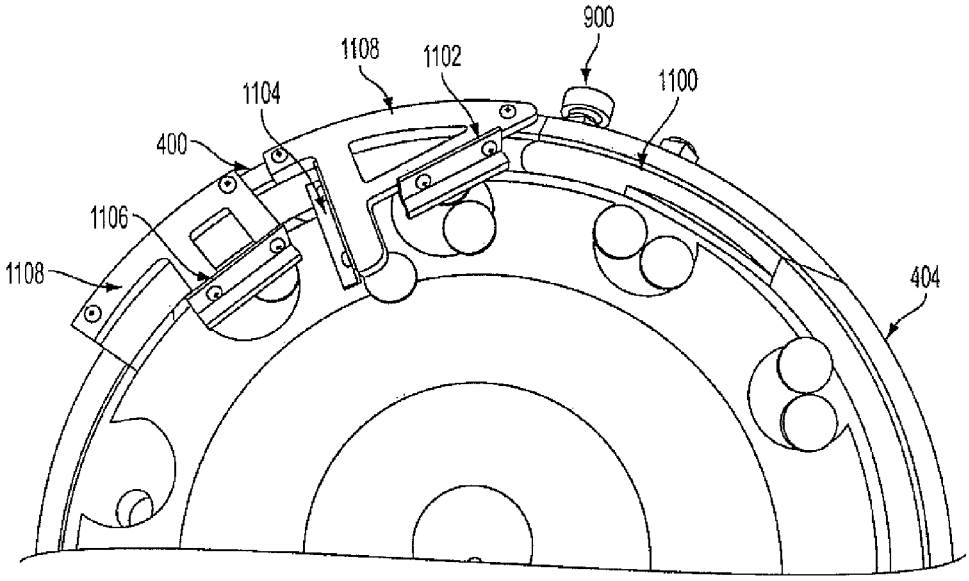
FIG. 11 illustrates an elevation view of a non-limiting embodiment of a coin removal mechanism of the present invention.

As illustrated in FIG. 11, the coin acceptor mechanism 202 also includes a deflecting spring 1100 in combination with a plurality of brushes 1102, 1104 and 1106 for clearing extra coins from the scalloped portions 602 of the pick-up wheel 308. The deflecting spring 1100 is formed of a resilient material, such as spring metal, and is disposed on the inner wall of the dumping ring 404. The deflecting spring 1100 is configured to extend outward from the inner wall of the dumping ring 404 and towards the center of the coin acceptor mechanism 202 so as to deflect extra, or double pick-up, coins away from the inner wall of the dumping ring 404 and towards the center of the coin acceptor mechanism 202. The plurality of brushes 1102, 1104 and 1106 are attached to the larger fixed wall member 400 via at least one mounting member 1108 and are adapted to skim the surface of the pick-up-wheel 308 as the drive motor 908 rotates the pick-up wheel 308.

The first brush 1102 is attached to the larger fixed wall member 400 so as to form an acute angle with the fixed wall member 400. In this configuration, the first brush 1102 assists in deflecting an extra coin away from the inner wall of the larger fixed wall member 400 and towards the center of the coin acceptor mechanism 202. The second brush 1104 is attached to the larger fixed wall member 400 so as to be substantially perpendicular to the fixed wall member 400. In this configuration, the second brush 1104 completes the removal of an extra coin from a scalloped portion 602 in the pick-up wheel 308 by effectively guiding the extra coin away from the inner wall of the larger fixed wall member 400 and down to the lower portion of the coin acceptor mechanism 202. The third brush 1106 is attached to the larger fixed wall member 400 so as to be substantially parallel to the fixed wall member 400. In this configuration, the third brush 1106 stabilizes and seats the remaining coin in a scalloped portion 602 of the pick-up wheel 308 so that the coin may be properly stabilized, detected and classified during coin validation at the coin validation region 502. Accordingly, the third brush 1106 is mounted substantially over the coin validation region 502 and must be at a sufficient height to allow the brush 1106 to skim and exert a downward force on a coin seated in a scalloped portion 602.

In addition, the plurality of brushes 1102, 1104 and 1106 are located at the top portion of the coin acceptor mechanism 202 so that the influence of gravity imparted by the inclined support member 906 assists in removing extra coins from the pick-up wheel 308 and directs them down to the lower portion of the coin acceptor mechanism 202. The height of the brushes 1102, 1104 and 1106 may be adjustable so that the amount of downward force generated by the brushes 1102, 1104 and 1106 skimming the surface of the pick-up wheel 308 or a coin in a scalloped portion 602 may be controlled for each brush 1102, 1104 and 1106. In that manner, the deflecting spring 1100 in combination with the plurality of brushes 1102, 1104 and 1106 serve to both remove extra coins from the scalloped portions 602 of the pick-up wheel 308 and to properly seat coins passing over the coin validation region 502, which prevents more than one coin from entering the coin validation region 502 and improves the efficiency and accuracy of coin validation.

The outer periphery portion 326 of the pick-up wheel 308 may be formed of a Polyacetal Copolymer and the backing plate 304 may be formed of a hardened Teflon coated aluminum to reduce the amount of moving friction, and therefore wear, when the outer periphery portion 326 of the pick-up wheel 308 moves in sliding contact with the backing plate

304. A hard wearing lining may be used on the inner walls of the fixed wall members 400 and 402 as well as the dumping ring 404 to prevent excessive wear on the respective inner walls caused by any sliding contact with coins. The hopper 800 may be constructed of a transparent material to allow coins therein to be more easily viewed. Further, it is to be understood that the features of the circular base 300 may be formed integrally with the backing plate 304 to form a unitary part with the features of both the circular base 300 and the backing plate 304.

Escrow Assembly

Figure 12:
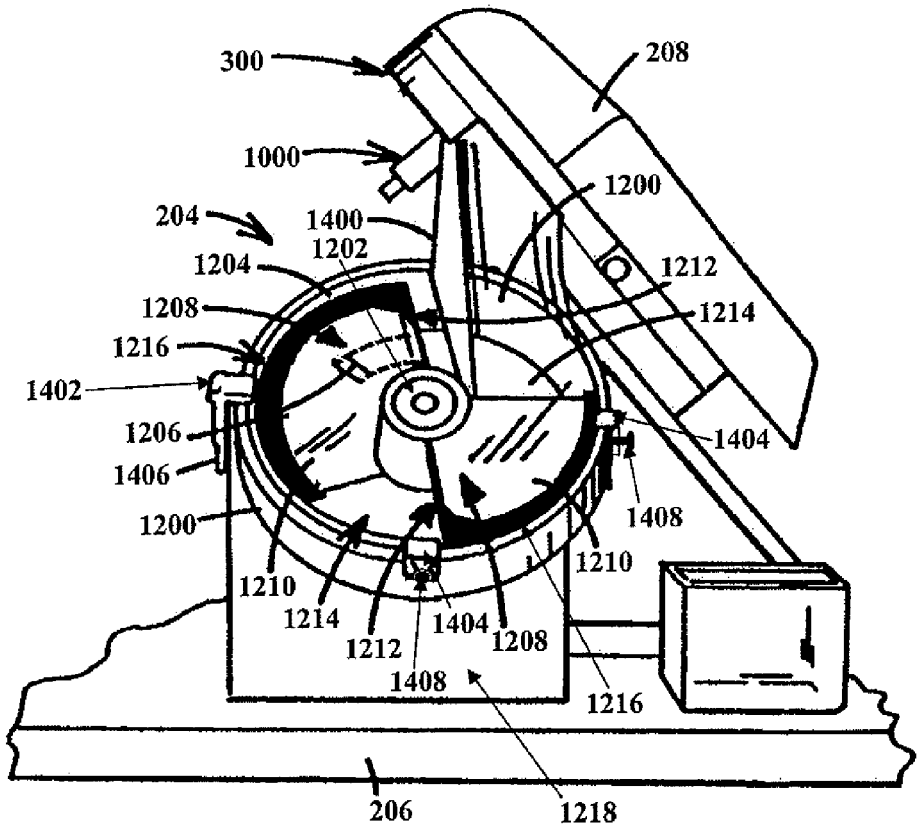
FIG. 12 illustrates a side elevation of the coin validation apparatus illustrated in FIG. 2.

As illustrated in FIG. 12, the escrow assembly 204 includes a cylindrical housing 1200, a rotatable escrow paddle 1202 and an escrow cover 1204. The cylindrical housing 1200 comprises an annular sidewall extending from the perimeter of a circular bottom surface that forms a substantially hollow cylinder with an open top. A coin outlet aperture 1206 is disposed at an upper portion of the bottom surface of the cylindrical housing 1200 through which coins may exit the escrow assembly 204 via a guide portion 810 (see FIG. 8A) that connects the escrow assembly 204 to a vault chamber (not shown) disposed below the planar base 206 of the coin validation apparatus 200. In that manner, accepted coins are deposited in the vault chamber.

The escrow paddle 1202 is rotatably installed in the cylindrical housing 1200 and is adapted to push coins through the coin outlet aperture 1206 of the cylindrical housing 1200. The escrow paddle 1202 comprises at least two radially extending arms 1208, each of which includes a ramped portion 1210 terminating in a radially extending abutment wall 1212. The ramped portions 1210 rise at an angle from the bottom surface of the cylindrical housing 1200 substantially to the top of the sidewall of the cylindrical housing 1200 such that the extending arms 1208 effectively separate the housing into separate compartments 1214 in which accepted coins may be held until the correct number and classification of coins is deposited therein by the coin acceptor mechanism 202. The ramped portions 1210 rise at an angle so that accepted coins slide down into the compartments 1214 formed by radially extending arms 1208 when the escrow paddle 1202 rotates. The coins are then pushed by a corresponding trailing abutment wall 1212 as the escrow paddle 1202 in a circular path around the cylindrical housing 1200 and through the coin outlet aperture 1206.

As illustrated in FIGS. 8A and 12, the escrow assembly 204 is supported at an incline by a support member 1218 so that accepted coins that are deposited into the compartments 1214 formed by radially extending arms 1208 will fall under the influence of gravity to the lower portion of the escrow assembly 204. Once the coins are deposited into a compartment 1214 of the escrow assembly, the coins will then slide up the ramped portion 1210 of the lower-most radially extending arm 1208 under the influence of gravity where the coins can be more easily viewed through the escrow cover 1204, which is preferably formed from a transparent material. The escrow paddle 1202 includes two paddle inserts 1216 to prevent coins from jamming between the escrow cover 1204 and the escrow paddle 1202 when accepted slide up the ramped portion 1210 in this manner.

After the correct number and classification of accepted coins is deposited in the respective compartment 1214, the escrow paddle 1202 will advance stepwise. The escrow paddle 1202 is driven stepwise by a drive motor 812 (see FIG. 8A) that is mounted on a back surface of the support member 1218 and is connected to the escrow paddle 1202 in a manner that allows the drive motor 812 to induce rotational movement of the escrow paddle 1202. The manner in which the drive motor 812 is connected to the escrow paddle 1202 may include a clutch for engaging and disengaging with the escrow paddle 1202 as required to prevent damage in the event of jamming. In addition, speed and position sensing means (not shown) are associated with the escrow paddle 1202 to control its operation and timing. The functionality of these elements is described in more detail in U.S. Pat. No. 5,240,099 to Brown et al., the disclosure of which is incorporated herein by reference.

Figure 13:
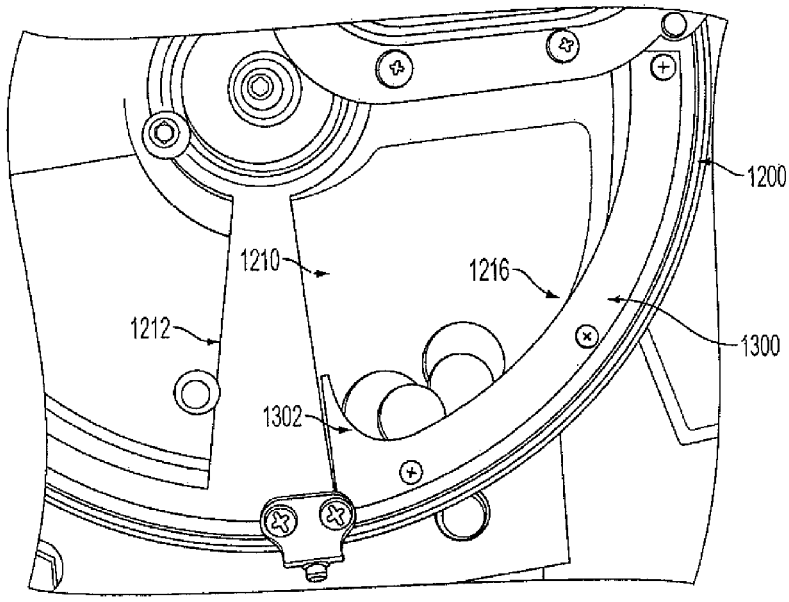
FIG. 13 illustrates a plan view of a non-limiting embodiment of the paddle insert illustrated in FIG. 12.

As illustrated in FIG. 13, the paddle insert 1216 comprises a semi-circular portion 1300 with at least one rounded outer edge corresponding to the inside diameter of the cylindrical housing 1200. The paddle insert 1216 extends from an inner surface of the annular sidewall of the cylindrical housing 1200 towards the center of the escrow assembly 204 at an angle substantially perpendicular to the annular sidewall of the cylindrical housing 1200. Accordingly, the paddle insert 1216 forms a retaining lip at a top edge of the escrow paddle 1202 that prevents accepted coins from lodging against the escrow cover 1204 when they slide up the ramped portion 1210 of the lower-most radially extending arm 1208. The paddle insert 1216 is disposed above the ramped portion 1210 of each respective radially extending arm 1208 and is attached to the top edge of the escrow paddle 1202.

The paddle insert 1216 also includes an extended curved portion 1302 that extends radially from an end of the semi-circular portion 1300 and towards the center of the escrow assembly 204 further than the remaining portions of the paddle insert 1216. The extended curved portion 1302 includes a rounded inner edge of a smaller diameter than that of the paddle insert 1216 to increase the surface area of the paddle insert 1216 where it transitions to the extended curved portion 1302. The extended curved portion 1302 of each paddle insert 1216 is disposed above the upper-most edge of the ramped portion 1210 of each respective radially extending arm 1208. Accordingly, as compared to a paddle insert 1216 with no extended curved portion 1302, the paddle insert 1216 with an extended curved portion 1302 provides additional protection from coins jamming between the escrow paddle 1202 and the escrow cover 1204 by providing additional material where coins are most likely to gather and stack, i.e., at the upper-most edge of the ramped portion 1210 of each respective radially extending arm 1208.

Figure 14A:
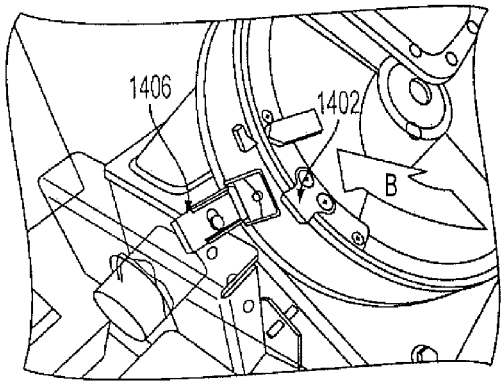
FIGS. 14A and 14B illustrate orthogonal views of the operation of a non-limiting embodiment of the escrow cover latching system of the present invention.
Figure 14B:
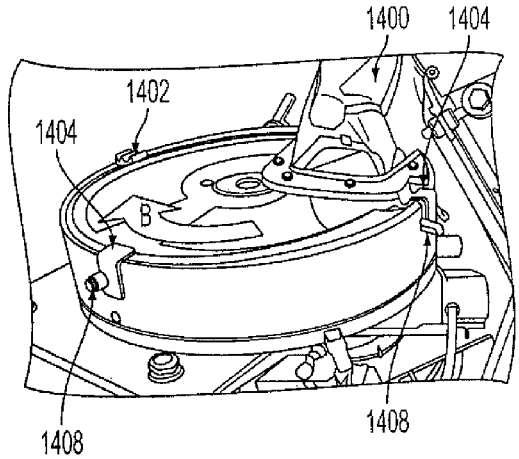

As illustrated in FIGS. 14A and 14B, the escrow cover 1204 includes an entry chute 1400, a latch catch 1402, and a plurality of cam catches 1404. The entry chute 1400 is attached to a top surface of the escrow cover 1204 at an opening therein and is configured to connect with the discharge slot 500 in the backing plate 304 and to guide accepted coins into the compartments 1214 formed by the radially extending arms 1208. The latch catch 1402 is disposed at a peripheral edge of the escrow cover 1204 and is configured to receive a latching mechanism 1406 disposed on an outer surface of the sidewall of the cylindrical housing 1200. The plurality of cam catches 1404 are also disposed at a peripheral edge of the escrow cover 1204 and are each configured to receive a respective cam 1408 disposed on an outer surface of the sidewall of the cylindrical housing 1200. The cams 1408 extend substantially perpendicular from an outer surface of the sidewall of the cylindrical housing 1200. The latch catch 1402 extends substantially parallel to the top surface of the escrow cover and is adapted to receive a clamping force from the latching mechanism 1406. The plurality of cam catches 1404 extend substantially perpendicular to the top surface of the escrow cover and are adapted to hook around the cams 1408 when the escrow cover 1204 is rotated in the direction of arrow "B".

With the escrow cover 1204 rotated so that the plurality of cam catches 1404 engage their respective cams 1408, the latch catch 1402 will be in alignment with the latching mechanism 1406. With the latch catch 1402 and latching mechanism 1406 in alignment, the latching mechanism 1406 can be used to engage the latch catch 1402 and apply a minimal clamping force to the escrow cover 1204 to hold it in place on the cylindrical housing 1200. The clamping force is minimized because the cam catches 1404 and cams 1408 serve to hold the escrow cover 1204 in place using lateral forces rather than downward, clamping forces. As compared to a configuration in which only a plurality of latch catches are utilized, this configuration reduces the amount of distortion of the escrow cover by minimizing the clamping forces placed on the escrow cover, thereby helping to prevent coins from jamming between the escrow cover 1204 and the escrow paddle 1202 as a result of such distortion.

Coin Validation

As discussed above, the automatic coin validation apparatus 200 includes a coin validation device (not shown) embedded in the coin validation region 502 of the backing plate 304. The coin validation device may, for example, include a non-contact electromagnetic sampling unit associated with a microprocessor that can both detect and classify coins as the coins pass the coin validation region 502 based on each coin's diameter, thickness, resistivity and/or composition. Alternatively, other forms of coin detection devices may be employed such as photo-electric or mechanical devices for detecting coin diameters. The coin validation device is associated with a microprocessor that controls the operation of the coin validation apparatus 200.

In the exemplary embodiment wherein a non-contact electromagnetic sampling unit is utilized as the coin validation device, a validation process is employed to prevent corruption of the pulses utilized during coin validation. Instead of incorporating a detection pulse into a classification as is done in conventional single-stage coin validation processes, the microprocessor separates the detection pulse set and the classification pulse set into separate pulse sets and switches between them based on the signals produced by the respective pulse set. Moreover, rather than limiting the detection process to a single pulse that is fixed within a pulse set as is done in conventional coin validation processes, the microprocessor utilizes a plurality of detection pulses. The detection pulse set is used to establish when a coin enters the coin validation region 502 and when a coin leaves the coin validation region 502. The classification pulse set is used to classify the denomination of the coin in the coin validation region 502.

Figure 15:
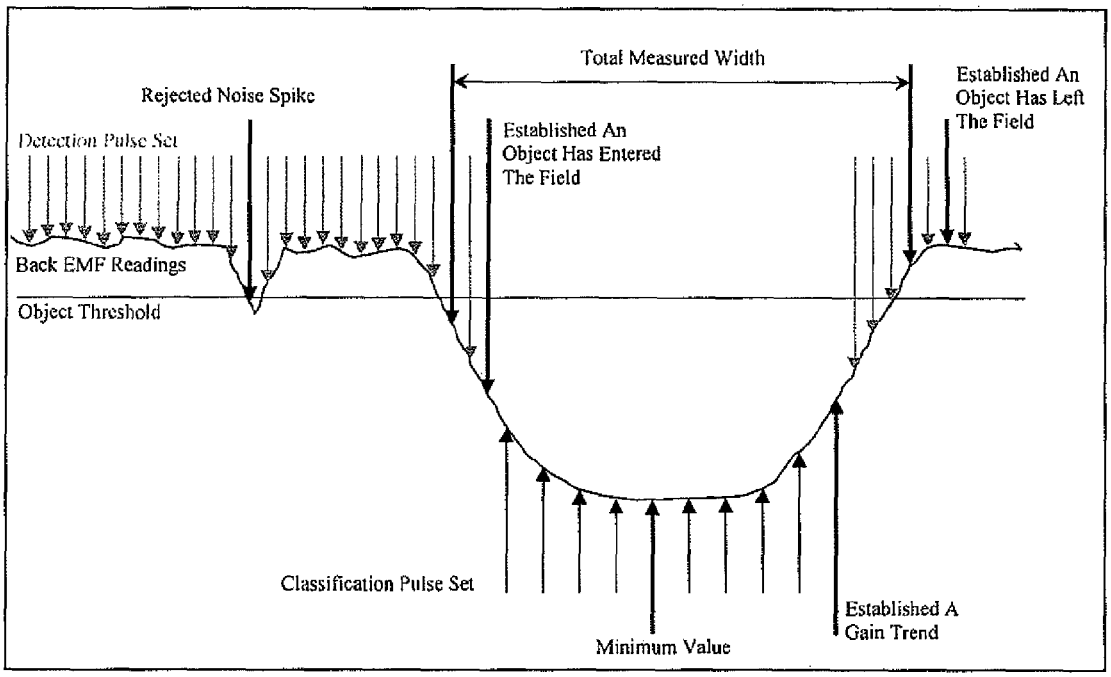
FIG. 15 illustrates a graph depicting a non-limiting embodiment of the operation of the coin validation pulse sets of the present invention.

As illustrated in FIG. 15, the microprocessor causes the coin validation device to generate a detection pulse set comprising a plurality of consecutive repeating pulses. The detection pulse set is generated until the signals produced by the detection pulse set establish that a coin has entered the coin validation region 502. Two conditions must occur to establish that a coin has entered the coin validation region 502. First, the resulting signals must drop from a nominal value to a value below a predetermined object threshold and, second, the resulting signals must establish a dropping trend. A dropping trend is established when two or more consecutive pulses in the detection pulse set produce increasingly smaller, or more negative, signals. By utilizing multiple detection pulses to establish that a coin has entered the coin validation region 502, single noise pulses, or noise spikes, are prevented from registering as an object and triggering the coin rejection mechanism 1000.

After the signal produced by the detection pulse set establishes that a coin has entered the coin validation region 502, the microprocessor stops generating the detection pulse set and starts generating a classification pulse set. The classification pulse set comprises a plurality of consecutive repeating pulses. The classification pulse set is generated until the signals produced by the classification pulse set establish that a coin is leaving the coin validation region 502. Two conditions must also occur to establish that a coin is leaving the coin validation region 502. First, the resulting signals must reach a minimum value and, second, the resulting signals must establish a gaining trend. A gaining trend is established when two or more consecutive pulses in the classification pulse set produce increasingly larger, or less negative, signals, wherein the lowest prior reading is established as the minimum value. The minimum value is used to establish a signature that identifies the denomination of the coin in the coin validation region 502. And, because the detection pulse set is not being generated during the classification pulse set, the resulting coin signature is not corrupted by the detection pulse set, which results in more accurate classifications of coins.

Then, after a gaining trend is established for the signal produced by the classification pulse set, the microprocessor stops generating the classification pulse set and resumes generating the detection pulse set. It is established that the coin has left the coin validation region when the signals produced by the detection pulse set rise above the object threshold and return to the nominal value. The nominal value may correspond to a value generated substantially by back EMF signals. The detection pulse set is then generated until it is established that another coin has entered the coin validation region 502 as described above, thereby starting the process over again.

By utilizing a detection pulse set with a plurality of pulses and by switching between detection pulse sets and classification pulse sets in this manner, not only is the classification of coins more accurate, but greater accuracy of the total width measurement for a coin is achieved. The width of the coin is determined from the first signal produced by the detecting pulse that is below the object threshold and the first signal produced by a detecting pulse that is above the object threshold. Those signals respectively represent when the leading edge of a coin enters the coin validation region 502 and when the trailing edge of the coin leaves the coin validation region 502. Accordingly, by comparing the time between those two signals with a predetermined speed at which the coin is traveling, i.e., the speed of the pick-up wheel 308, the microprocessor calculates the width of the coin. Due to the frequency at which the individual pulses in the detection pulse set are generated, an accurate measurement of the coin width is obtained. In that manner, the width of every coin passing through the coin validation region is consistently and accurately measured. Using the width of the coin to determine its denomination provides a second level of analysis in the classification of each coin, which results in even more accurate classifications of coins, as compared to conventional coin validation processes wherein width measurements are used as an alternative classification step when coin signatures overlap and aren't sufficient to definitively determine the denomination of a coin.

Operation

In an exemplary embodiment, the automatic coin validation apparatus 200 is mounted on a vault chamber and is installed in a coin collection location, such as a toll booth, with the hopper 800 in communication with any suitable intake chute at the coin collection location such that coins are received by the hopper 800 via the intake chute. While in use, the pick-up wheel 308 is constantly driven by its motor 908. When coins are received by the hopper 800, the coins fall under the influence of gravity to the lower portion of the coin acceptor mechanism 202 where the coin guiding portion 806 of the hopper 800 guides the coins between the base wall portion 804 of the hopper 800 and the outer periphery portion 326 of the pick-up wheel 308 so that the coins adopt a position substantially parallel to the plane of the pick-up wheel 308. In that position, the coins will slide into the scalloped portions 602 at the outer periphery portion 326 of the pick-up wheel 308 under the influence of gravity where they are guided in a circular path around the backing plate 304 by a trailing edge of the respective scalloped portion 602. Traveling in that path, each coin passes the coin validation region 502 where each coin is either accepted or rejected using the coin validation process described above. Only a single coin should travel in each scalloped portion 602 and through the coin validation region.

To ensure that only one coin travels in each scalloped portion 602, the distance between the base wall portion 804 of the hopper 800 and the outer periphery portion 326 of the pick-up wheel 308 is adjustable using the adjustment screws 808. Accordingly, the distance between the base wall portion 804 of the hopper 800 and the outer periphery portion 326 of the pick-up wheel 308 can be adjusted using the adjustment screws 808 so that only one coin will fit therebetween. This distance must be at least enough to accommodate a coin of the largest thickness of the accepted currency. If coins become arranged so that at least one coin is superimposed on top of another between the base wall portion 804 of the hopper 800 and the outer periphery portion 326 of the pick-up wheel 308, the upper-most coin will engage the base wall portion 804 of the hopper 800 and cause the hopper 800 to lift against gravity away from the circular base 300 by rotating about the rotatable links 900 disposed in mounting holes 408, whereby the frictional force exerted on the upper-most coin by the base wall portion 804 of the hopper 800 will cause that coin to be removed from on top of the other. After the superimposed coin is removed from the top of the other coin(s), the hopper 800 will return to its normal position. The hopper 800 will perform in a similar manner should any foreign material be deposited into the hopper 800 or if any other type of coin jam were to occur. In addition, the crank 902 can be actuated to cause the dumping ring to pivot to the position shown in dotted outline in FIG. 9 so that that foreign material or coin jams are dumped from the coin acceptor mechanism 202.

Although the scalloped portions 602 in the outer periphery portion 326 of the pick-up wheel 308 are configured so that only one coin will lie flush with the backing plate 304 therein, a portion of an additional coin may become partially disposed in a scalloped portion 602 that already has a coin in it, thereby causing the additional coin to travel in the circular path of the scalloped portion 602 with the coin lying flush therein. In addition, because the base wall portion 804 of the hopper 800 is located a distance from the outer periphery portion 326 of the pick-up wheel 308 sufficient to allow a single coin to fit therebetween, a coin may become superimposed on top of a coin lying flush in a scalloped portion 602 without frictionally engaging the base wall portion 804 of the hopper 800 due to the increased clearance provided by the scalloped portion 602. Accordingly, it is possible that an additional coin partially disposed in a recess or a coin superimposed on a coin lying flush in a recess will continue to travel in the circular path of the scalloped portion 602 beyond the lower section of the hopper 800 and towards the upper portion of the coin acceptor mechanism 202. Although the influence of gravity may remove a partially disposed or superimposed coin from a scalloped portion 602 and cause the coin to return to the hopper 800, the present invention provides additional measures for ensuring that any such extra coin is removed from each scalloped portion 602 before the coin lying flush in the respective scalloped portion 602 reaches the coin validation region 502.

When the influence of gravity does not remove an extra coin from a scalloped portion 602 after the coin leaves the lower section of the hopper 800, the deflecting spring 1100 and the first brush 1102 and second brush 1104 will operate together to remove any extra coins from the scalloped portion 602 prior to the scalloped portion 602 reaching the coin validation region 502. As an extra coin travels in the circular path of the scalloped portion 602 towards the upper portion of the coin acceptor mechanism 202, the deflecting spring 1100 will deflect the extra coin away from the inner wall of the dumping ring 404 to which the deflecting spring 1100 is attached and direct it towards the center of the coin acceptor mechanism 202. After the extra coin passes the deflecting spring 1100 and is moved away from the inner wall of the dumping ring 404, the first brush 1102 will further deflect the extra coin away from the inner wall of the larger fixed wall member 400 to which the first brush 1102 is attached and direct it towards the center of the coin acceptor mechanism 202. Then, if the extra coin has not yet dislodged from the scalloped portion 602 and fallen back into the hopper 800 under the influence of gravity, the second brush 1104 will complete the removal of the extra coin from the scalloped portion 602 by guiding the extra coin away from the inner wall of the larger fixed wall member 400 to which the second brush 1104 is attached by directing the extra coin at a 90 degree angle down towards to the lower portion of the coin acceptor mechanism 202. In this manner, the first brush 1102 and second brush 1104 improve the efficiency and accuracy of coin validation by ensuring that a maximum of one coin is in each scalloped portion 602 as the scalloped portion 602 passes over the coin validation region 502.

After a scalloped portion 602 passes the second brush 1104, the scalloped portion 602 moves into the coin validation region 502. The coin that remains lying flush within the scalloped portion 602 is stabilized and seated flush within the scalloped portion 602 by the third brush 1106, thereby placing and retaining the coin in the optimal position to be detected and classified during coin validation. In that manner, the third brush 1106 improves the accuracy of coin validation by controlling the coin while it travels through the coin validation region 502, which allows increased pick-up wheel 308 speeds and improved efficiency.

If valid coins are detected and classified during coin validation, the value of that coin is registered by the microprocessor and the coin proceeds in the circular path of the scalloped portion 602 until it reaches the coin discharge slot 500 in the backing plate 304, which the coin falls through under the influence of gravity. The coin is then deposited into the escrow assembly 204 via the entry chute 1400 of the escrow cover 1204. Because the escrow assembly 204 is disposed on the support member 1218 at an angle, gravity causes coins deposited into the escrow assembly 204 to fall into the compartments 1214 formed by the radially extending arms 1208 of the escrow paddle 1202 and to slide up the ramped portions 1210 of the lower-most escrow paddle 1202 where the coins can be readily viewed through the transparent escrow cover 1204. The escrow assembly 204 is adapted so that its drive motor 812 moves the escrow paddle 1202 stepwise, ensuring that the ramped portion 1210 of an escrow paddle 1202 is positioned at the lower-most portion of the escrow assembly 204 whenever the escrow paddle 1202 is not being rotated by the drive motor 812.

When the coins deposited in the escrow assembly 204 slide up the ramped portion 1210 of an escrow paddle 1202, the momentum imparted on the coins by gravity induces the coins to become jammed between the escrow paddle 1202 and the escrow cover 1204. The paddle insert 1216 acts to interrupt the momentum of the coins as coins move towards the escrow cover 1204 or contact coins already deposited in the respective compartment 1214, thereby preventing coins from jamming between the escrow paddle 1202 and the escrow cover 1204. And, when the accepted coins begin to gather at the lower-most portion the escrow paddle 1202, the extended curved portion 1302 of the paddle insert 1216 further interrupts the momentum of coins moving towards the escrow cover 1204 or contacting coins deposited in the respective compartment 1214, especially those coins already gathered at the lower-most portion the escrow paddle 1202. In that manner, the escrow paddle prevents coins from jamming between the escrow paddle 1202 and the escrow cover 1204, which at least improves the efficiency of the escrow assembly 204.

When the correct number and denomination of accepted coins have been received, as detected during coin validation and registration by the microprocessor, the drive motor 812 of the escrow assembly 204 is actuated so as to cause stepwise rotation of the escrow paddle 1202. As the escrow paddle 1202 rotates, the coins slide down the ramped portion 1210 and into one of the compartments 1214 formed by the radially extending arms 1208 where the coin is pushed by a corresponding trailing abutment wall 1212. The abutment wall 1212 pushes the accepted coins in a circular path around the cylindrical housing 1200 of the escrow assembly 204 and into the coin outlet aperture 1206 disposed in the bottom surface of the cylindrical housing 1200. The coins then pass into a vault chamber (not shown) where the coins are stored until removed.

If an invalid coin is detected and/or classified during coin validation, the microprocessor will cause the coin rejection mechanism 1000 to trigger when the scalloped portion 602 in which the invalid coin is disposed passes above the coin rejecter aperture 504, thereby causing rapid advancement of the plunger 1002 so as to eject the invalid coin from the corresponding scalloped portion 602. The ejected invalid coin is then directed back to a customer via the coin return chute 208. The microprocessor properly times advancement of the plunger 1002 so that advancement occurs when the scalloped portion 602 in which the invalid coin is disposed has moved from the coin validation region 502 to a location above the coin rejecter aperture 504 and retracts the plunger 1002 before the corresponding scalloped portion 602 moves beyond the coin rejecter aperture 504 so as to prevent the plunger 1002 from interfering with the rotational movement of the pick-up wheel 308.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A coin acceptor mechanism with a coin pick-up wheel for advancing coins in a radial path, the pick-up wheel comprising a plurality of scalloped portions disposed at a peripheral edge thereof that each includes:

a first rounded portion of a first radius extending into the peripheral edge of the pick-up wheel having a first radius;

a second rounded portion of a second radius disposed in a trailing edge of the first rounded portion and having a second radius;

a chamfered portion extending along a top edge of the first rounded portion and the second rounded portion;

an internal edge extending perpendicular from a bottom surface of the pick-up wheel along a bottom edge of the first rounded portion and the second rounded portion and intersecting the chamfered portion; and a straight portion disposed between the peripheral edge of the pick-up wheel and the second rounded portion for guiding the coins into the second rounded portion, wherein the straight portion includes a beveled portion for reducing the surface area thereof and preventing coins from getting caught thereon as the coin wheel advances coins.

2. The coin acceptor mechanism according to claim 1, wherein the pick-up wheel has a thickness greater than 2.2 mm.

3. The coin acceptor mechanism according to claim 1, wherein the internal edge has a thickness greater than 1.0 mm.

4. The coin acceptor mechanism according to claim 1, wherein the second radius is approximately 9.0 mm.

5. The coin acceptor mechanism according to claim 1, wherein the straight portion is approximately 2.2 mm long.

6. The coin acceptor mechanism according to claim 1, wherein the chamfered portion is at an angle of approximately 14° from a top surface of the pick-up wheel.

7. The coin acceptor mechanism according to claim 1, wherein the pick-up wheel is formed from a Polyacetal Copolymer material.

8. The coin acceptor mechanism according to claim 1, wherein the coins comprise a first coin and at least a second coin and the coin acceptor mechanism further comprises:

a circular base;

an annular wall disposed around the pick-up wheel at a peripheral edge of the circular base;

a deflection spring disposed on the annular wall and configured to deflect the at least second coin away from the annular wall when the at least second coin becomes at least one of superimposed on the first coin and partially disposed in a scalloped portion;

at least one first brush disposed on the annular wall that is configured to complete removal of the at least second coin from the scalloped portion prior to the scalloped portion moving past a coin validation area as the pick-up wheel rotates; and at least one second brush disposed on the annular wall that is configured to accomplish at least one of seating flush and stabilizing the first coin in the scalloped portion as the scalloped portion moves past the coin validation area.

9. The coin acceptor mechanism according to claim 8, wherein the planar base includes a backing plate disposed therein with a coin validation region formed by an aperture extending through a peripheral portion of the backing plate that is adapted to receive a coin validation coil assembly mounted therein.

10. The coin acceptor mechanism according to claim 8, wherein the annular wall includes a movable annular dumping ring portion adapted to pivot around rotatable links and lift away from the circular base to allow unwanted coins or debris to exit the coin acceptor mechanism.

11. The coin acceptor mechanism according to claim 1, further comprising:

a circular base with a top surface;

a pressure plate disposed on a top surface of the pick-up wheel that is configured to maintain the pick-up wheel a desired distance from the top surface of the circular base without covering up the plurality of scalloped portions; and a retaining knob disposed through an aperture in the pressure plate that is configured to attach to a rotating shaft and retain the pick-up wheel at the desired distance from the top surface of the circular base with pressure from the pressure plate, wherein the desired distance is a distance that prevents a coin in a scalloped portion from becoming jammed between the pick-up wheel and the top surface of the circular base.

12. The coin acceptor mechanism according to claim 11, wherein the top surface of the planar base comprises a backing plate disposed therein with a coin validation region formed by an aperture extending through a peripheral portion of the backing plate that is adapted to receive a coin validation coil assembly mounted therein.

13. The coin acceptor mechanism according to claim 11, wherein the pressure plate includes a recessed portion in a bottom surface thereof that is adapted to concentrate pressure at an outer periphery of the pressure plate.

14. The coin acceptor mechanism according to claim 11, wherein the pick-up wheel includes a recessed portion disposed in the top surface thereof; and the pressure plate includes a chamfered outer periphery portion and is disposed in the recessed portion of the pick-up wheel so as to create a smooth transition between the top surface of the pick-up wheel and the chamfered periphery portion of the pressure plate.

15. The coin acceptor mechanism according to claim 14, wherein the recessed portion has a depth of approximately 0.5 mm.

16. The coin acceptor mechanism according to claim 11, wherein the pick-up wheel is installed on a boss plate that is attached to the rotating shaft; and at least one shim is installed between at least one of the pick-up wheel and the boss plate and the pressure plate and the pick-up wheel to maintain the pick-up wheel at the desired distance from the top surface of the circular base.

17. The coin acceptor mechanism according to claim 1, wherein the coin acceptor mechanism also includes a coin escrow assembly attached thereto, the coin escrow assembly comprising:

a cylindrical housing having a peripheral wall extending from a bottom surface thereof and a coin outlet aperture extending through the bottom surface;

an escrow paddle rotatably disposed in the cylindrical housing and having at least two arms extending radially from a central portion thereof, the at least two radially extending arms comprising a ramped portion configured to cause at least one coin to slide down onto the bottom surface of the cylindrical housing as the escrow paddle rotates, and an abutment surface configured to move at least one coin in a path along the bottom surface of the cylindrical housing as the escrow paddle rotates until the coin is deposited through the coin outlet aperture;

an escrow cover disposed on a top edge of peripheral wall so as to substantially enclose the escrow assembly; and a paddle insert configured to prevent the at least one coin from becoming jammed between the escrow cover and the escrow paddle, the paddle insert comprising a semi-circular portion configured to mount flush with the peripheral wall, and an extended curved portion extending radially from an end of the semi-circular portion and configured to further prevent the at least one coin from becoming jammed between the escrow cover and the escrow paddle by providing additional material where the at least one coin is most likely to become jammed.

18. The coin acceptor mechanism according to claim 1, wherein the coin acceptor mechanism also includes a coin escrow assembly attached thereto, the coin escrow assembly comprising:

a cylindrical housing comprising a peripheral wall extending from a bottom surface of the cylindrical housing, a latching mechanism disposed on an outer surface of the peripheral wall, and a plurality of cams disposed on the outer surface of the peripheral wall, wherein the latch mechanism and the plurality of cams are disposed a substantially equal distance apart near a top edge of the peripheral wall;

an escrow paddle rotatably disposed in the cylindrical housing; and an escrow cover disposed on a top edge of peripheral wall so as to substantially enclose the escrow assembly, the escrow cover comprising a latch catch configured to engage with the latching mechanism with minimal clamping force when the latch catch is in alignment with the latching mechanism, and a plurality of cam catches with openings therein each configured to receive one of the plurality of cams as the latch catch is aligned with the latching mechanism, wherein the latch catch is aligned with the latching mechanism by placing the escrow cover on the top edge of the peripheral wall and rotating the escrow cover until the latch catch is positioned directly above the latching mechanism and the cam catches receive the cams.

19. The coin acceptor mechanism according to claim 1, wherein the coin acceptor mechanism further includes a non-contact electromagnetic sampling unit that is configured to identify and validate coins by:

applying a first pulse set to determine when a coin enters a coin validation area;

applying a second pulse set to determine the classification of the coin in the coin validation area; and applying the first pulse set to determine when the coin leaves the coin validation area, wherein applying the first pulse set and applying the second pulse set do not occur concurrently.

20. An automatic coin validation apparatus, comprising:

a coin acceptor mechanism that comprises a circular base with a top surface, a coin pick-up wheel for advancing coins in a radial path, the coins comprising a first coin and at least a second coin, and the pick-up wheel comprising a plurality of scalloped portions disposed at a peripheral edge thereof that each includes a first rounded portion of a first radius extending into the peripheral edge of the pick-up wheel, a second rounded portion of a second radius disposed in a trailing edge of the first rounded portion, a chamfered portion extending along a top edge of the first rounded portion and the second rounded portion, an internal edge extending perpendicular from a bottom surface of the pick-up wheel along a bottom edge of the first rounded portion and the second rounded portion and intersecting the chamfered portion, and a straight portion disposed between the peripheral edge of the pick-up wheel and the second rounded portion for guiding the coins into the second rounded portion, the straight portion including a beveled portion for reducing the surface area thereof and preventing coins from getting caught thereon as the coin wheel advances coins, an annular wall disposed around the pick-up wheel at a peripheral edge of the circular base, a deflection spring disposed on the annular wall and configured to deflect the at least second coin away from the annular wall when the at least second coin becomes at least one of superimposed on the first coin and partially disposed in a scalloped portion, at least one first brush disposed on the annular wall that is configured to complete removal of the at least second coin from the scalloped portion prior to the scalloped portion moving past a coin validation area as the pick-up wheel rotates, at least one second brush disposed on the annular wall that is configured to accomplish at least one of seating flush and stabilizing the first coin in the scalloped portion as the scalloped portion moves past the coin validation area, a pressure plate disposed on a top surface of the pick-up wheel that is configured to maintain the pick-up wheel a desired distance from the top surface of the circular base without covering up the plurality of scalloped portions, and a retaining knob disposed through an aperture in the pressure plate that is configured to attach to a rotating shaft and retain the pick-up wheel at the desired distance from the top surface of the circular base with pressure from the pressure plate, the desired distance being a distance that prevents a coin in a scalloped portion from becoming jammed between the pick-up wheel and the top surface of the circular base;

a coin escrow assembly that comprises a cylindrical housing comprising a peripheral wall extending from a bottom surface of the cylindrical housing, a coin outlet aperture extending through the bottom surface, a latching mechanism disposed on an outer surface of the peripheral wall, and a plurality of cams disposed on the outer surface of the peripheral wall, the latching mechanism and the plurality of cams being disposed a substantially equal distance apart near a top edge of the peripheral wall, an escrow cover disposed on a top edge of the peripheral wall so as to substantially enclose the escrow assembly, the escrow cover comprising a latch catch configured to engage with the latching mechanism with minimal clamping force when the latch catch is in alignment with the latching mechanism, and a plurality of cam catches with openings therein that are each configured to receive one of the plurality of cams as the latch catch is aligned with the latching mechanism, the latch catch being aligned with the latching mechanism by placing the escrow cover on the top edge of the peripheral wall and rotating the escrow cover until the latch catch is positioned directly above the latching mechanism such that the cam catches receive the cams, and an escrow paddle rotatably disposed in the cylindrical housing and having at least two arms extending radially from a central portion thereof, the at least two radially extending arms comprising a ramped portion configured to cause at least one coin to slide down onto the bottom surface of the cylindrical housing as the escrow paddle rotates, and an abutment surface configured to move at least one coin in a path along the bottom surface of the cylindrical housing as the escrow paddle rotates until the coin is deposited through the coin outlet aperture, a paddle insert configured to prevent the at least one coin from becoming jammed between the escrow cover and the escrow paddle, the paddle insert comprising a semi-circular portion configured to mount flush with the peripheral wall, and an extended curved portion extending radially from an end of the semi-circular portion and configured to further prevent the at least one coin from becoming jammed between the escrow cover and the escrow paddle by providing additional material where the at least one coin is most likely to become jammed; and a non-contact electromagnetic sampling unit that is configured to identify and validate coins by applying a first pulse set to determine when a coin enters a coin validation area, applying a second pulse set to determine the classification of the coin in the coin validation area, and applying the first pulse set to determine when the coin leaves the coin validation area, wherein applying the first pulse set and applying the second pulse set do not occur concurrently.

* * * * *